US007418215B2

(12) United States Patent
Ide

(10) Patent No.: US 7,418,215 B2
(45) Date of Patent: Aug. 26, 2008

(54) DEVELOPING DEVICE WITH TONER AND MAGNETIC CARRIER, AND IMAGE FORMING APPARATUS USING THE DEVELOPING DEVICE

(75) Inventor: Osamu Ide, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 355 days.

(21) Appl. No.: 11/313,812

(22) Filed: Dec. 22, 2005

(65) Prior Publication Data

US 2007/0041738 A1 Feb. 22, 2007

(30) Foreign Application Priority Data

Aug. 22, 2005 (JP) ..... 2005-240432

(51) Int. Cl.
*G03G 15/08* (2006.01)
*G03G 15/09* (2006.01)

(52) U.S. Cl. ..... 399/27; 399/55; 399/270

(58) Field of Classification Search ..... 399/27, 399/49, 53, 55, 270
See application file for complete search history.

(56) References Cited

U.S. PATENT DOCUMENTS 6,925,269 B2 * 8/2005 Hibino ..... 399/55

FOREIGN PATENT DOCUMENTS

JP 7-325468 12/1995
JP 10-142908 5/1998

* cited by examiner

*Primary Examiner*—William J Royer
(74) *Attorney, Agent, or Firm*—Morgan Lewis & Bockius LLP

(57) ABSTRACT

A developing device includes a developing housing which faces an image carrier on which an electrostatic latent image is carried and stores a developer which contains toner and magnetic carrier; a developer carrier that is disposed apart from the image carrier in the developing housing and carries and transports the developer; a developing bias applying unit that is disposed between the image carrier and the developer carrier and applies a developing bias comprising an AC component and a DC component which is superposed to a DC component; a volume resistivity detecting unit which detects a volume resistivity of the developer on the developer carrier; and a developing bias adjusting unit which sets the AC component of the developing bias to a reference value when the volume resistivity of the developer detected by the volume resistivity detecting unit falls within a given range, and corrects the AC component of the developing bias such that an image quality evaluation parameter falls within an allowable range when the volume resistivity of the developer exceeds the given range.

7 Claims, 14 Drawing Sheets

DEVELOPING DEVICE WITH TONER AND MAGNETIC CARRIER, AND IMAGE FORMING APPARATUS USING THE DEVELOPING DEVICE

BACKGROUND OF THE INVENTION

1. Field of the Invention

The present invention relates to a developing device which is used in a copying machine, a printer or the like, and more particularly to a developing device which enables an acquisition of an image of high image quality by adjusting a developing bias at the time of developing and improvement of an image forming apparatus which uses the developing device.

2. Description of the Related Art

Conventionally, in an image forming apparatus such as a copying machine, a printer or the like which adopts electrophotography, there has been known a developing method which uses a two-component developer containing toner and carrier and a photoreceptor is directly developed with a magnetic brush of a developer. In such a developing method, when the developing is continuously performed, the density of toner in the developer or the like is changed and hence, an image quality of an output image is changed.

To the contrary, even when the change of toner density is simply detected and the toner is replenished in response to the detection of the change, it is difficult to obtain the proper image quality due to a change with time in the fluidity and the charging property of the developer per se.

Further, in general, to obtain the high image quality, there has been known a technique which superposes an AC component on a DC component which constitutes a developing bias. By superposing the AC component to the developing bias, it is possible to obtain an advantage that the image density of a solid portion (a matted portion), fogging of a background (a non-image portion), fine-line reproducibility, graininess and the like are enhanced. Accordingly, there has been proposed a method which aims at the maintenance of image quality by changing amplitude and frequency of an AC component of a developing bias in conformity with the use history or the like of the developing device.

In the method described above, the frequency of an AC component of a developing bias is changed based on the input image information, the output image information, and the use environment information of a developing device. By preliminarily obtaining the relationship between the frequency and the gradation of an output image (density level of an output image) and by changing the frequency corresponding to the change of the charging property, it is possible to obtain the image which sufficiently ensures the gradation of the output image. Further, according to the method described above, the use environment information of the developing device includes the use history information such as the number of developing times, the change of the charging property of the toner and the like.

Further, according to another technique, the use history of a developer is estimated based on the number of times that the developing is performed, a developing time, a charging property change of a photoreceptor and the like, or the use history of a developer is detected based on the change of toner charging property or the resistance change of a carrier, and an amplitude of an AC component of a developing bias is changed in response to an estimated value or a detected value to perform the correction with respect to a change with time in the fluidity of the developer, whereby the transfer performance of the toner can be maintained.

Surely, according to the above-mentioned methods, compared to a method which holds the AC component of the developing bias at a fixed value, the gradation and the transfer performance may be maintained for a long period. However, in these methods, a developing amount when the developer per se is changed (for example, a developing amount being different substantially due to the change of easiness of mobility of toners in the developer) and the relationship between banding (stripe-like density irregularities which appear in a half tone portion of an image) or the like and the developing bias are not taken into consideration at all. Further, even when a current change of the developing bias is detected as described above, the method merely detects the influence which are relevant to both of the developer and the photoreceptor and does not directly detect the change of the developer thus giving rise to a drawback that the maintenance of proper image quality becomes insufficient.

Usually, along with the use of the developer, a rate of toner amount in the developer may be changed, the toner and the carrier may be changed, and the degree of concentration of the developer may be changed. Accordingly, it is extremely important to properly grasp changes of characteristics of the developer and to maintain the proper image quality.

SUMMARY OF THE INVENTION

The present invention has been made in view of the above-mentioned circumstances and provides a developing device.

According to an aspect of the invention, the developing device includes a developing housing that faces an image carrier on which an electrostatic latent image is carried and stores a developer which contains toner and magnetic carrier; a developer carrier that is disposed apart from the image carrier in the developing housing and carries and transports the developer; a developing bias applying unit that is disposed between the image carrier and the developer carrier and applies a developing bias for developing the electrostatic latent image on the image carrier, the developing bias comprising an AC component and a DC component, the AC component being superposed to the DC component; a volume resistivity detecting unit that detects a volume resistivity of the developer on the developer carrier; and a developing bias adjusting unit that sets the AC component of the developing bias to a reference value when the volume resistivity of the developer detected by the volume resistivity detecting unit falls within a given range, and corrects the AC component of the developing bias to cause an image quality evaluation parameter to fall within an allowable range when the volume resistivity of the developer exceeds the given range.

BRIEF DESCRIPTION OF THE DRAWINGS

Embodiments of the present invention will be described in detail based on the following figures, wherein.

DETAILED DESCRIPTION OF THE INVENTION

Hereinafter, the present invention is explained in detail based on embodiments shown in the attached drawings.

Figure 2:
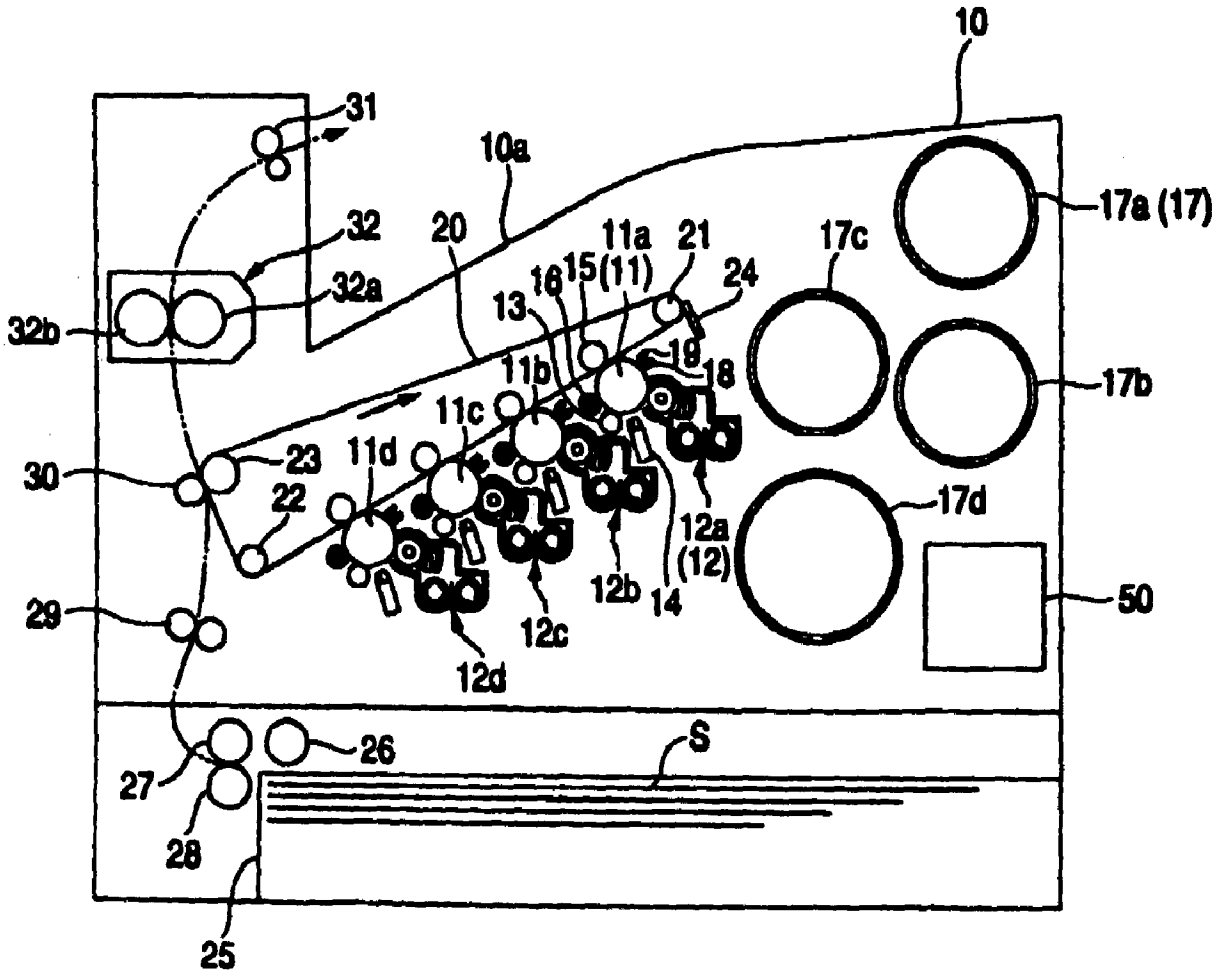
FIG. 2 RELATED ART
FIG. 2 is an explanatory view showing an embodiment of an image forming apparatus to which the present invention is applied.

FIG. 2 shows an embodiment of an image forming apparatus to which the present invention is applied.

In the drawing, the image forming apparatus of this embodiment is a so-called tandem-type color image forming apparatus. In the inside of an apparatus body 10, for example, photoreceptor drums 11 (11*a* to 11*d*) on which toner images of respective color components (for example, yellow (Y), magenta (M), cyan (C), black (K)) are formed and carried by an electrophotography method, for example, are arranged in parallel on an intermediate transfer belt 20.

Further, around the photoreceptor drums 11, a charging device 13 such as a charging roll which charges the photoreceptor drums 11, an exposure device 14 formed of an LED array or the like which forms an electrostatic latent image on the charged photoreceptor drums 11, developing devices 12 (12*a* to 12*d*) which visualize latent images formed on the photoreceptor drums 11 with toner, and a primary transfer device 15 such as a transfer roll which is provided at a position where the primary transfer device 15 faces the photoreceptor drums 11 in an opposed manner with the intermediate transfer belt 20 sandwiched therebetween and transfers a toner image on the photoreceptor drum 11 to the intermediate transfer belt 20. Here, numeral 16 indicates a cleaning device formed of a cleaning brush or the like which cleans residual toner on the photoreceptor drums 11. Numeral 18 indicates a density sensor made of an optical sensor, for example, which measures the image density of the toner image formed on the photoreceptor drums 11, and numeral 19 indicates a potential sensor which measures a photoreceptor potential (a charge potential, an exposure part potential) on the photoreceptor drums 11.

The intermediate transfer belt 20 is extended over three tension rolls 21 to 23, wherein, for example, the tension roll 22 is circularly moved in an arrow direction in the drawing as a drive roll. Further, at a position of the intermediate transfer belt 20 which faces the tension roll 21 in an opposed manner which is positioned on an upstream side of the photoreceptor drum 11*a*, a belt cleaner 24 which cleans residual toner on the intermediate transfer belt 20 is provided in a state that the belt cleaner 24 can be brought into contact with or separated from the intermediate transfer belt 20.

Further, in the inside of the apparatus body 10, toner replenishing bottles 17 (17*a* to 17*d*) which replenish respective color toners to the respective developing devices 12 (12*a* to 12*d*) are provided and the toner can be supplied to the respective devices 12 by way of communication passages not shown in the drawing. Here, in a mode in which the developing devices 12 include mechanisms which recover and discharge the extra developer from the device per se, in place of toner in the inside of the toner replenishing bottle 17, the developer containing a suitable amount of carrier may be used.

Still further, in this embodiment, a controller 50 which performs a control of the developing bias which features the present invention is provided in the inside of the apparatus body 10.

Further, in this embodiment, below the apparatus body 10, a paper feed cassette 25 which can supply a paper S which is used as a recording material is mounted in a state that the paper feed cassette 25 can be drawn out from the apparatus body 10. Further, in the vicinity of the paper feed cassette 25, a pickup roll 26 which picks up the paper S from the paper feed cassette 25, a feed roll 27 and a retard roll 28 are arranged on a downstream side of the pickup roll 26 in a state the feed roll 27 and the retard roll 28 face the pickup roll 26 in an opposed manner, and by shuffling the papers S which are picked up, only one uppermost paper is transported to a given paper S transport path.

Further, on the downstream side of these parts, a resist roll 29 which imposes a positional restriction on the shuffled and transported paper S is provided, while on the downstream side of the resist roll 29, a secondary transfer device 30 such as a second transfer roll or the like which collectively transfers a toner image which is primarily transferred to the intermediate transfer belt 20 is arranged using the tension roll 23 as a backup roll.

Further, on the downstream side of the secondary transfer device 30, a fixing device 32 which fixes the toner image transferred to the paper S is arranged, wherein the fixing device 32 is constituted of a heating roll 32*a* and a pressurizing role 32*b*, for example. Further, on a downstream of the fixing device 32 and on an end portion of the apparatus body 10, a discharge roll 31 which discharges the paper S with which the fixing is finished to a discharge tray 10*a* which is mounted on a surface of a housing of the apparatus body 10 is arranged.

Figure 3:
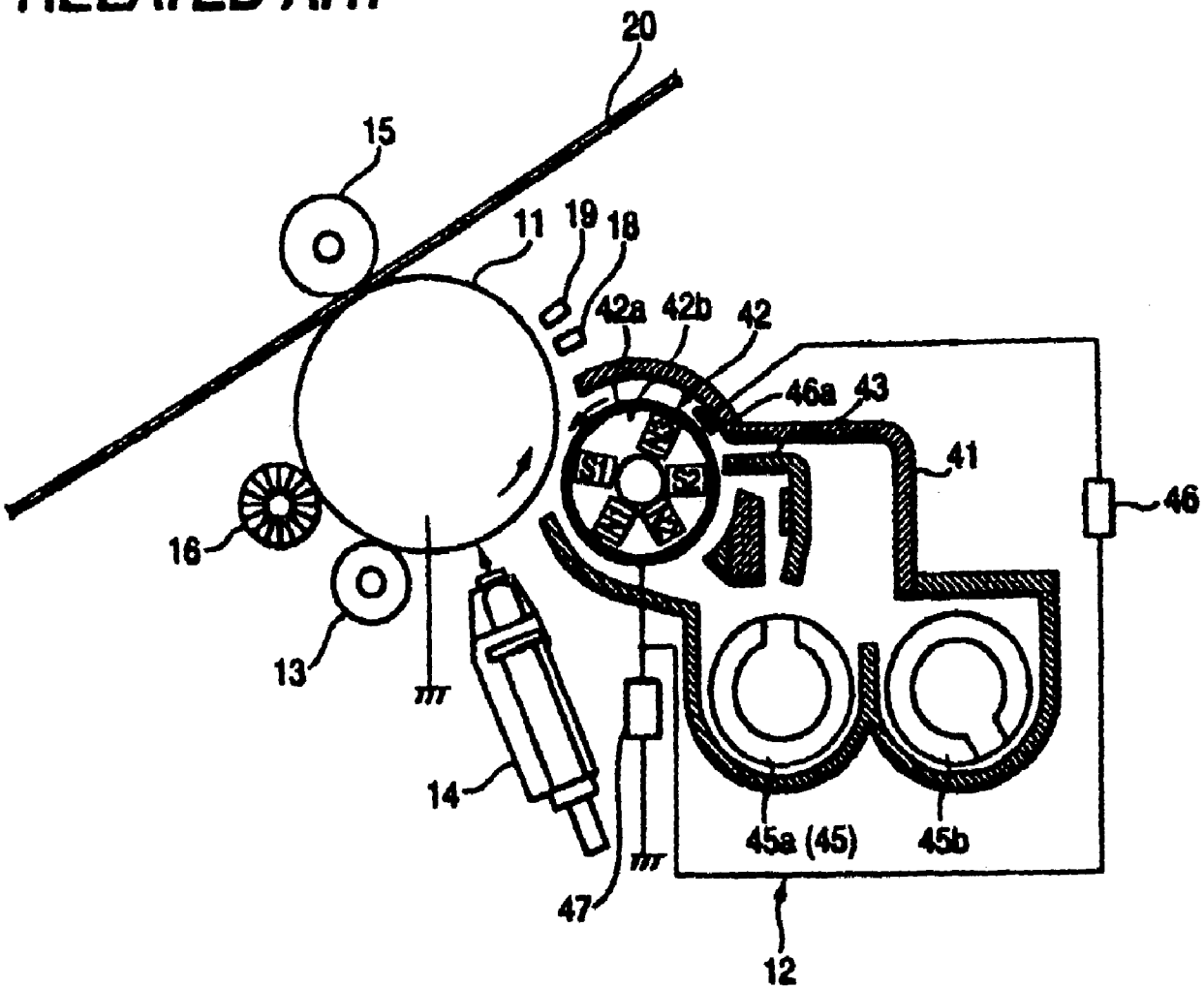
FIG. 3 RELATED ART
FIG. 3 is an explanatory view showing the developing device of the embodiment.

With respect to the developing device 12 of this embodiment, as shown in FIG. 3, a two-component developer which contains toner and magnetic carrier is accommodated in the inside of a developing housing 41, and a developing roll 42 which carries the developer is provided to an opening portion of the developing housing 41 in a state that the developing roll 42 faces the photoreceptor drum 11 in an opposed manner.

The developing roll 42 of this embodiment includes a rotatable non-magnetic developing sleeve 42*a*, and a magnetic body 42*b* which is fixedly arranged in the inside of the developing sleeve 42*a* and includes plural magnetic poles, wherein the developing sleeve 42*a* is configured to be rotated in the against direction together with the photoreceptor drum 11. Further, plural magnetic poles (S2, N3, S1, N1, N2) are arranged on an outer peripheral portion of the magnetic body 42*b*, wherein the magnetic pole S1 is arranged at a position which faces the photoreceptor drum 11 in an opposed manner, while a trimmer 43 which restricts a developer amount on the developing roll 42 is arranged at a position which faces the magnetic pole S2 in an opposed manner.

In this manner, according to this embodiment, in the magnetic body 42*b*, the magnetic pole N2 forms a pickup magnetic pole, the magnetic pole S2 forms a trimming magnetic pole, the magnetic pole N3 forms a transport magnetic pole, the magnetic pole S1 forms a developing magnetic pole, wherein the magnetic pole N1 and the magnetic pole N2 form repulsive magnetic poles (pickoff magnetic poles). Here, in this embodiment, the arrangement and the number of respective magnetic poles are not limited to values used in this embodiment and can be suitably selected without causing any problems.

Further, in this embodiment, a pair of augers 45 (45*a*, 45*b*) which performs the agitation, the transportation and the charging of the developer behind the developing roll 42 and, at the same time, performs the supply of the developer to the developing roll 42 are provided in a state that the auger 45*a* constitutes a supply auger and the auger 45*b* constitutes an admixing auger, for example.

Figure 4:
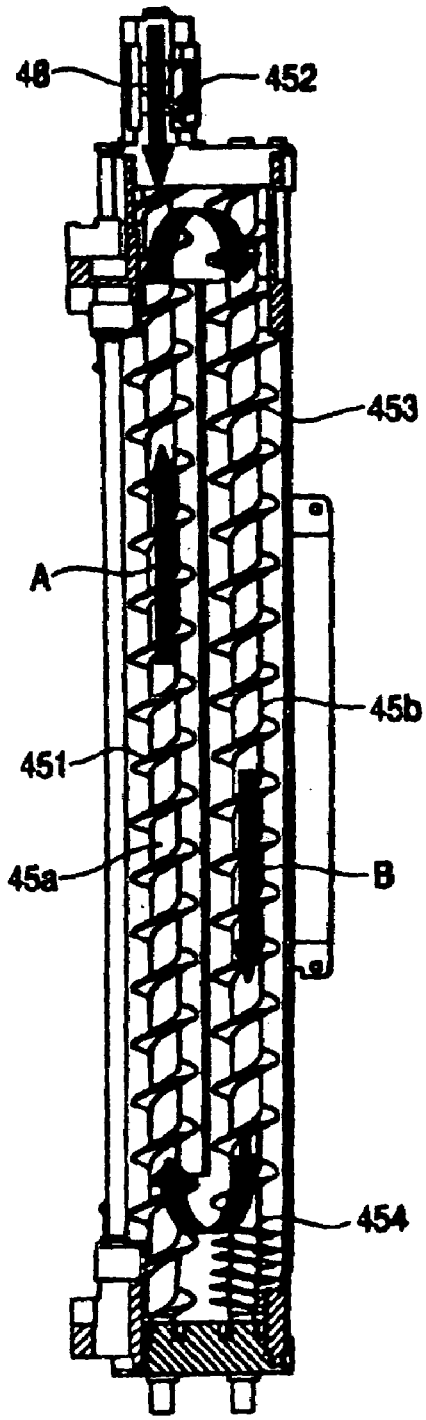
FIG. 4 RELATED ART
FIG. 4 is an explanatory view showing an auger in the inside of a developing housing of the embodiment.

Here, a cross section of the pair of augers 45 as viewed from above in FIG. 3 is shown in FIG. 4.

The supply auger 45*a* and the admixing auger 45*b* are provided with blades as shown in FIG. 4, wherein a spiral blade 451 which extend in the developer transport direction A is formed on the supply auger 45*a* over an approximately total length of the supply auger 45*a*, while a blade 452 which differs from the blade 451 in direction is formed on one end portion of the supply auger 45*a*. A given amount of toner is replenished to this one end portion from a toner replenishing device 70 described later by way of a communication port 48.

Further, a spiral-like blade 453 which extends in the developer transport direction B is formed on the admixing auger 45*b* over a substantially total length of the admixing auger 45*b*, while a narrow-pitched blade 454 which differs from the blade 453 in direction is mounted on one end portion.

Due to such a constitution, the toner which is replenished through the communication port 48 is mixed with the developer on the supply auger side and, thereafter, is immediately dammed up by the blade 451 of the supply auger 45*a*, and is led to the admixing auger side. Further, due to the rotation of the admixing auger 45*b*, the developer is transported in the B direction in a state that the mixing of the developer is enhanced.

Then, the developer which is sufficiently and uniformly mixed is dammed up by the blade 454 of the admixing auger 45*b* and is transported to the supply auger side.

Figure 5:
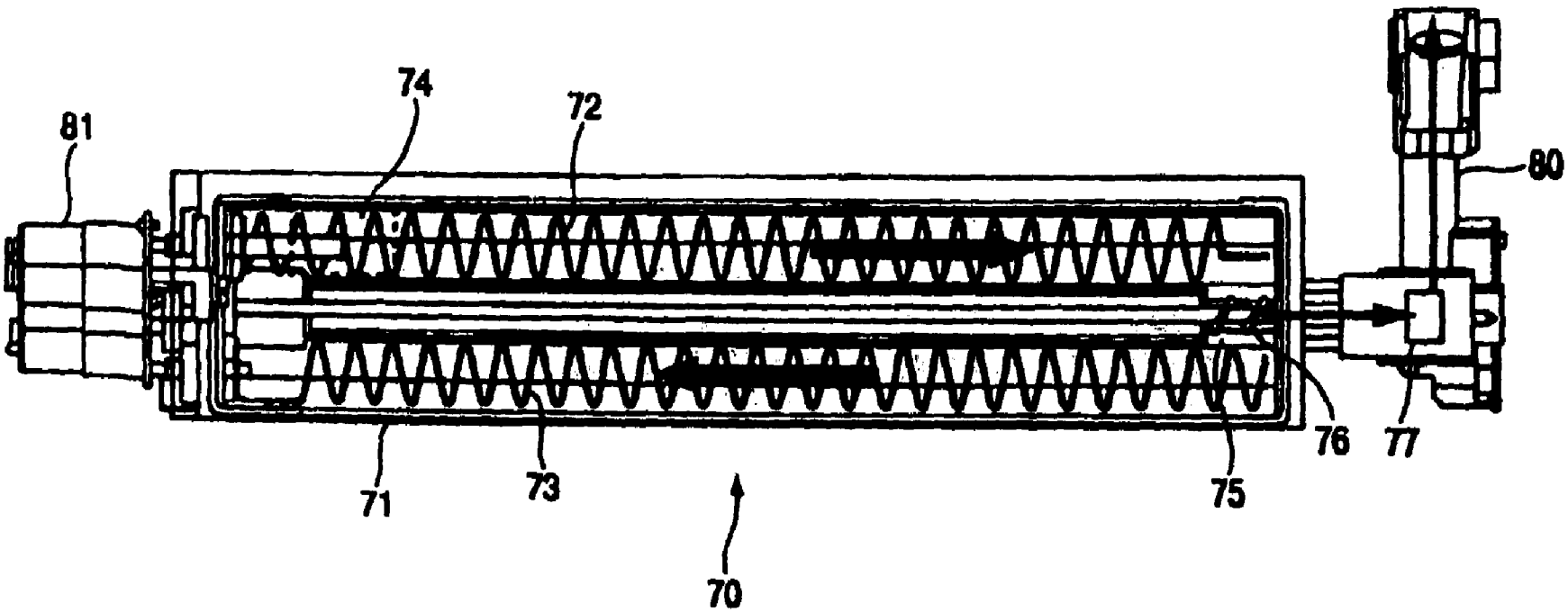
FIG. 5 RELATED ART
FIG. 5 is an explanatory view showing a toner replenishing device of the embodiment.

In this embodiment, the toner replenishing device 70 which supplies the toner to the communication port 48 (see FIG. 4) is configured as shown in FIG. 5.

In the drawing, in the inside of a reserve tank 71, two spiral coil augers 72, 73 are respectively provided, wherein the toner is transported in an arrow direction in the drawing in a circulating manner using these coil augers 72, 73. Further, on an upstream side of the coil auger 72, a toner charging opening 74 through which the toner is charged into the inside of the reserve tank 71 from the toner replenishing bottle 17 (see FIG. 2) is arranged. In a boundary between a downstream end side of the coil auger 72 and a downstream end side of another coil auger side, a discharge portion 75 is provided for supplying the toner to the developing housing 41 (see FIG. 3) from the reserve tank 71. The discharge portion 75 includes an auger 76 having a spiral blade for transporting the toner supplied to the discharge portion 75 to the developing housing 41. Here, the developer which is transported by the auger 76 reaches the developing housing 41 (to be more specific, corresponding to the communication port 48 shown in FIG. 4) from one end 77 of the discharge portion 75 by way of a toner transport passage 80.

Further, outside the reserve tank 71, the toner replenishing device 70 includes a drive device 81 which is constituted of a motor, transmission gears and the like, for example, for driving the two coil augers 72, 73 and the auger 76. By turning on-off the drive device 81, a given amount of toner is supplied to the developing housing side form the reserve tank 71.

Further, as shown in FIG. 3, in the developing device 12 of this embodiment, a bias power source 47 which constitutes a developing bias applying unit is connected to the developing sleeve 42*a* so as to apply a developing bias between the photoreceptor drum 11 which has one end thereof connected to a ground and the developing sleeve 42*a*.

Still further, as the developing bias of this embodiment, a developing bias which superposes an AC component to a DC component is used and a sinusoidal shape is used as the AC component. However, the AC wave form is not particularly limited to the sinusoidal shape and various shapes such as a triangular wave, a square wave and the like can be used. Further, in this embodiment, the bias power source 47 is controlled by the above-mentioned controller 50 (see FIG. 2).

Further, in this embodiment, the developing device 12 includes a volume resistivity detecting device 46 for detecting the volume resistivity of the developer which features the present invention. The volume resistivity detecting device 46 has one end thereof connected to an electrode plate 46*a* which is arranged on a downstream side of the trimmer 43 in the inside of the developing housing 41 in a state that the electrode plate 46*a* is brought into contact with the developer on the developing roll 42 and another end thereof electrically connected with the developing roll 42 (to be more specific, the developing sleeve 42*a*). Further, the electrode plate 46*a* in this embodiment is configured to be arranged close to the developing roll side (at least at a position where the electrode plate 46*a* is brought into contact with the developer) or retracted therefrom by a drive device not shown in the drawing.

Accordingly, in measuring the volume resistivity of the developer on the developing roll 42, the electrode plate 46*a* is moved to the developing roll side and measures the volume resistivity of the developer between the developing roll 42 and the electrode plate 46*a*. After completion of the measurement, by retracting the electrode plate 46*a*, the flow of the developer is not particularly obstructed and, at the same time, the charging property of the developer is not affected by the electrode plate 46*a*. Here, although the electrode plate 46*a* is formed of a flat plate in this embodiment, the electrode plate 46*a* may be formed to have a curved surface in conformity with the shape of the developing roll 42, for example. Further, provided that the electrode plate 46*a* possesses the conductive property which allows the measurement of the volume resistivity of the developer, a material thereof is not particularly limited. Further, to prevent the adhesion of the developer to the electrode plate 46*a*, it is also possible to perform a treatment to apply a peel-off layer or the like on a surface of the electrode plate 46*a*.

Here, since the size of the electrode plate 46*a* is unchanged, assuming that a layer thickness of the developer on the developing roll 42 (obtained based on a position at which the electrode plate 46*a* is arranged close to the developing roll 42) is fixed, the volume resistivity of the developer to be obtained becomes proportional to a resistance amount to be measured between the electrode plate 46*a* and the developing roll 42. Accordingly, with respect to the volume resistivity of the developer, it is unnecessary to calculate the accurate volume resistivity value and the value which is measured by the method adopted by this embodiment is effective. Here, in this embodiment, conditions are set such that a field strength of the developer layer becomes approximately $10^{3.8}$V/cm.

Figure 6:
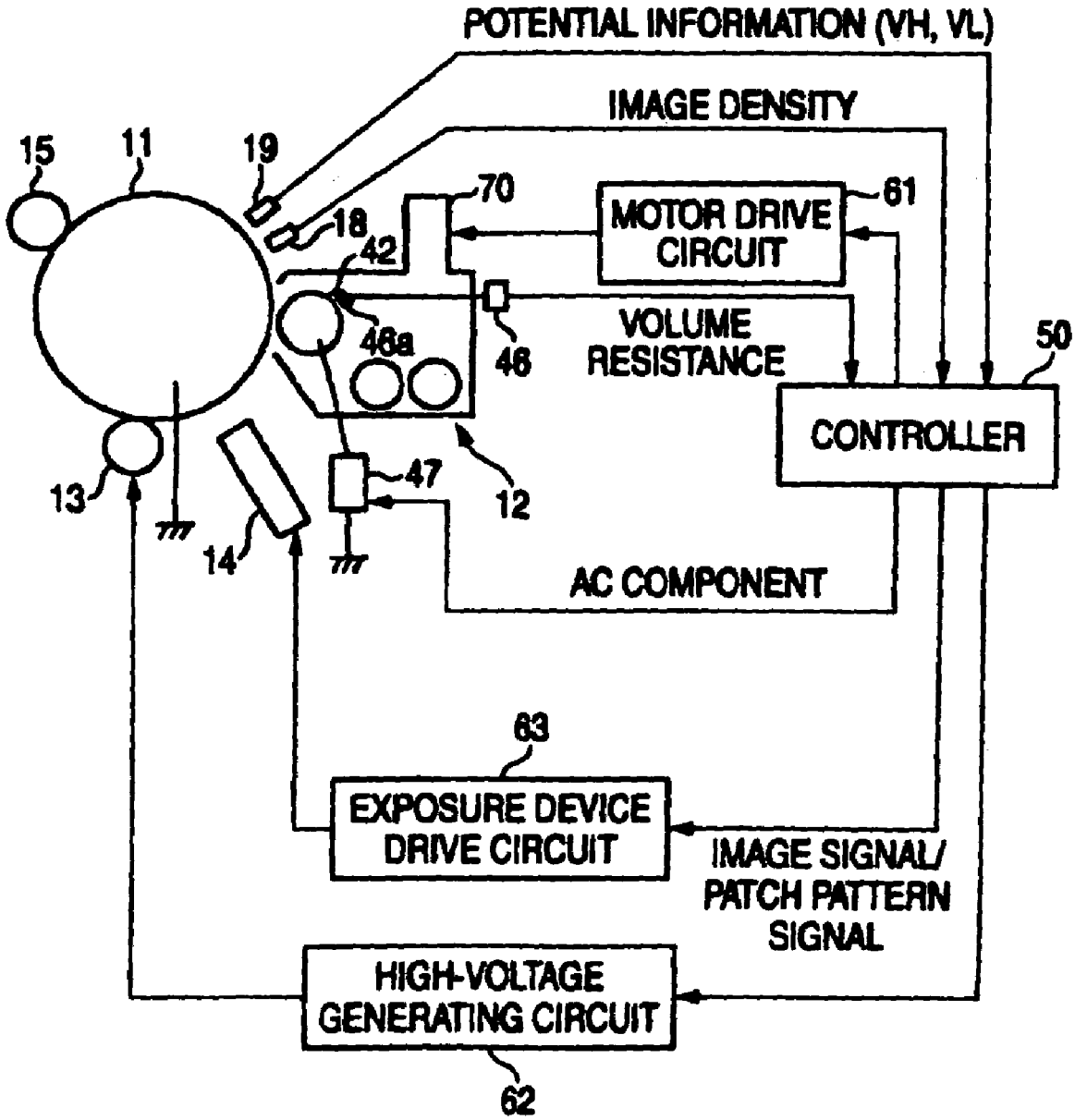
FIG. 6 is an explanatory view showing a circuit block of the embodiment.

Here, the developing devices 12 of this embodiment and a circuit block around the controller 50 are illustrated as shown in FIG. 6. For simplifying the drawing, only one-color developing device 12 is shown. In the drawing, to the controller 50, volume resistivity information of the developer on the developing roll 42 from the volume resistivity detecting device 46, information on the density of a patch pattern formed on the photoreceptor drum 11 from a density sensor 18, and potential information (charge potential VH, exposed portion potential VL) on the photoreceptor drum 11 from a potential sensor 19 are inputted.

On the other hand, the controller 50 is configured to perform a correction control which corrects the AC component of the bias power source 47 which supplies the developing bias, a control of a motor drive circuit 61 which drives a drive device 81 (see FIG. 5) of the toner replenishing device 70 which replenishes the toner to the inside of the developing device 12, a high-voltage generating circuit 62 which imparts a high-voltage potential to the charging device 13 which supplies the charging potential VH to the photoreceptor drum 11, and a supply control of a patch pattern signal for checking an image signal (a signal for forming an image) and the density of image to an exposure device drive circuit 63 which drives the exposure device 14 which supplies a latent image to the photoreceptor drum 11.

Figure 7:
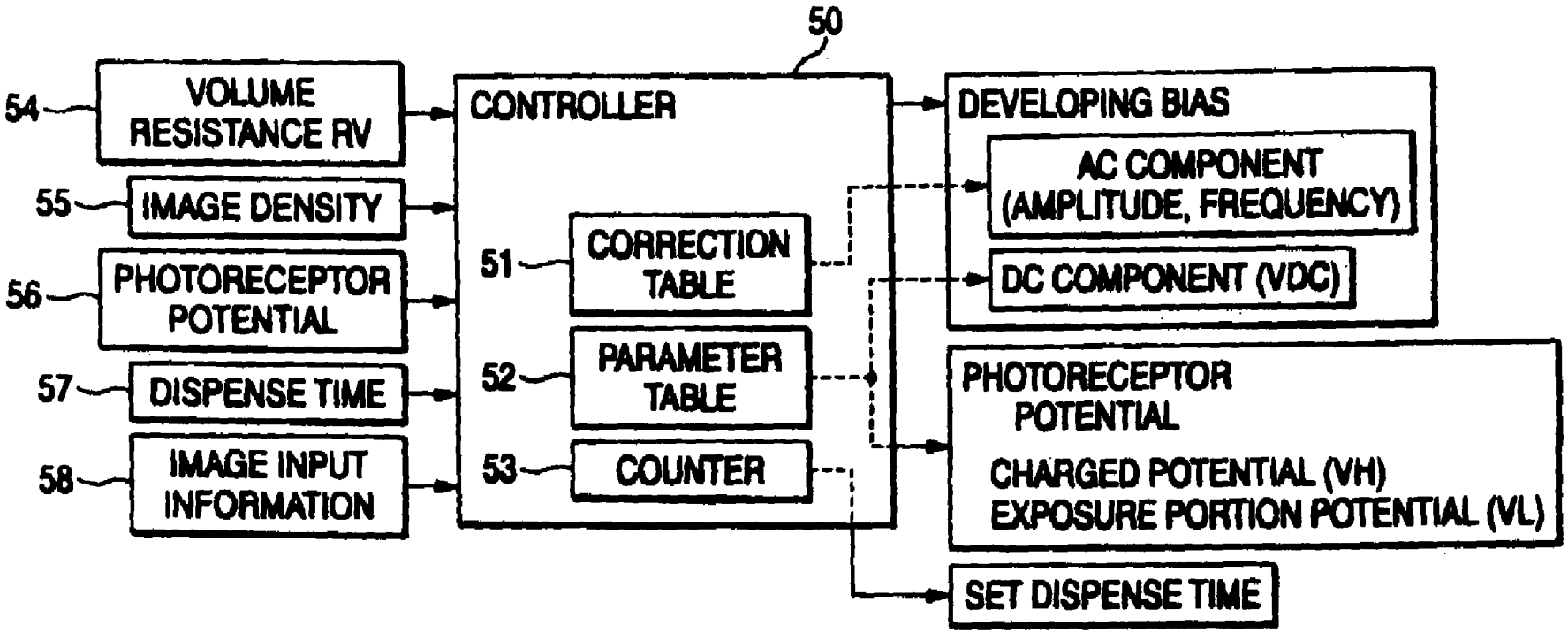
FIG. 7 is an explanatory view showing a control block of the embodiment.

On the other hand, the above-mentioned circuit block is further explained in more detail in conjunction with a control block focusing on the controller 50 shown in FIG. 7.

In the drawing, the controller 50 of this embodiment includes memories such as a correction table 51 in which table values which are obtained based on the relationship between the volume resistivity of the developer and the AC component of the developing bias for maintaining a proper image quality preliminarily by the controller 50 therein are stored, a parameter table 52 in which image forming conditions (excluding the AC component of the developing bias) for maintaining the proper image quality on the photoreceptor drum 11 are stored, a counter 53 which counts a working time of the toner replenishing device 70 and the inputted image density and the like. The controller 50 performs arithmetic processing based on the input information and the information of the memories using a CPU, for example.

As the input information of the controller 50, volume resistivity RV 54 of the developer from the volume resistivity detecting device 46, image density 55 from the density sensor 18 on the photoreceptor drum side, photoreceptor potential 56 from the potential sensor 19, working time (dispense time) 57 of the toner replenishing device 70, image input information 58 such as the input image density and the like are named.

The arithmetic processing is performed in the inside of the controller 50 based on these information thus performing the setting of the developing bias, the photoreceptor potential, the dispense time Dt and the like.

Here, the developing bias includes the DC component VDC and the AC component (including amplitude and frequency), wherein both components are controlled by the controller 50. Further, the photoreceptor potential includes the charging potential VH and the exposure portion potential VL, and the proper DC component VDC of the developing bias is calculated based on these values VH, VL.

Further, in this embodiment, the toner replenishing control (ICDC: Image Coverage Dispense Control) in which a proper toner replenishing amount is obtained based on the image input information 58 and the desired dispense time is calculated is performed. By counting the dispense time 57 and the input data from the image input information 58, using the counter 53, it is possible to set the next dispense time.

Next, the manner of operation of the developing device 12 of this embodiment is explained in conjunction with FIG. 3.

The developer which is charged by the admixing auger 45*b* and the supply auger 45*a* is supplied to the developing roll 42 from the supply auger 45*a* by the pick up magnetic pole N2 of the magnetic body 42*b* of the developing roll 42. The developer which is supplied to the developing roll 42 is attracted and transported to the developing sleeve 42*a* of the developing roll 42. The developer which passes the trimmer 43 is adjusted to a given amount and reaches a developing region which faces the photoreceptor drum 11 in an opposed manner. In the developing region, the developer is sufficiently effectively erected by the developing magnetic pole S1 and, at the same time, due to the developing bias generated by the bias power source 47, the toner in the developer is adhered to the latent image (image portion) on the photoreceptor drum 11 thus visualizing images (developed images) as the toner image.

The developer which passes the developing region is directly carried and transported along with the rotation of the developing sleeve 42*a*, is recovered from the developing sleeve 42*a* due to repulsive magnetic fields of the pick off magnetic poles N1, N2, and is made to return to the supply auger side.

Figure 8:
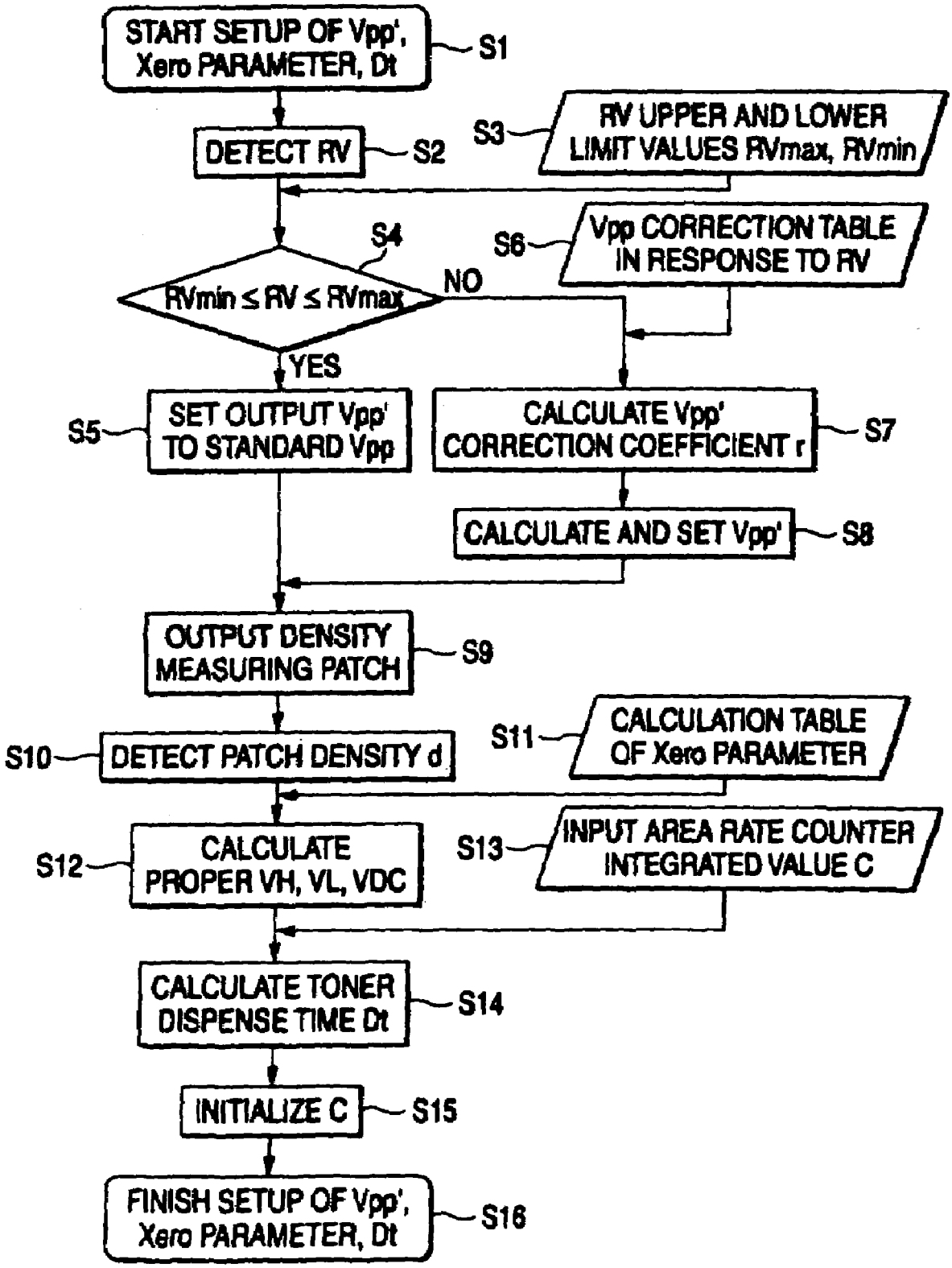
FIG. 8 is an explanatory view showing a control flow of the embodiment.

The manner of operation of the developing device 12 having the above-mentioned constitution is explained in detail in conjunction with a control flow of this embodiment using FIG. 8.

Here, to explain a case in which only the amplitude of the AC component of the developing bias is made variable, the developing device 12 is operated as follows. Here, symbol Vpp indicates the amplitude of the AC component, symbol Vpp' indicates an actual output value of the AC component, symbol TC indicates the toner density, symbol Dt indicates the dispense time per one sheet outputting, and the Xero parameters are parameters from which the AC component of the developing bias is removed among the respective image forming conditions.

When the power source is supplied to the device, the setting up of Vpp', the Xero parameter, Dt is started (for example, step S1). Then, when the volume resistivity RV of the developer is detected, it is determined whether the obtained volume resistivity RV falls within a range between a lower limit value RVmin and an upper limit value RVmax or not. Here, the upper limit value and the lower limit value of the volume resistivity RV are calculated based on the relationship between the outputted image quality and the volume resistivity RV. In a state that the developing bias is held as it is, when the volume resistivity RV exceeds an upper limit value, among the image evaluation parameters, particularly, fogging, graininess and banding are worsened, while when the volume resistivity RV becomes lower than the lower limit value, carrier fogging and graininess are worsened and, at the same time, the degradation of the developer is also generated (for example, steps S2 to S4).

Further, when the volume resistivity RV falls within the range as the result of the determination, Vpp' is set to the standard Vpp (when the Vpp' is set to the standard preliminarily, the situation is continued as it is), while in case Vpp' exceeds a given range, a collection coefficient r is calculated based on the correction table of Vpp corresponding to the volume resistivity RV (for example, steps S5 to S8).

Next, a density measuring patch for measuring density is outputted on the photoreceptor drum and the measurement of the patch density is performed using the density sensor. Thereafter, based on a result of the measurement, the proper photoreceptor potentials (VH, VL) and the DC component VDC of the developing bias are calculated in view of the Xero parameter calculation table (parameter table) (for example, steps S9 to S12).

Thereafter, the dispense time Dt of the toner is calculated based on an input-area-ratio counter integrated value C obtained by the counter (for example, steps S13, S14). Here, as a C value, an integrated value of image area ratios of the inputted images (proportional to a product of the image size, the average area ratio and the number of prints) in the printing after finishing of the setup of the preceding time.

Further, the input-area-ratio counter integrated value C is initialized to finish the set up (for example, steps S15, S16).

In this embodiment, by performing the above-mentioned flow of steps, when the power source is supplied or when the accumulated prints from the finishing of the setup of the preceding time reaches a predetermined value, even when the volume resistivity of the developer exceeds a predetermined range, the AC component of the developing bias is corrected and hence, the image quality can be maintained. Further, by performing such a flow for each color, the color image quality can be enhanced.

Further, in this embodiment, the amplitude of the AC component of the developing bias is changed. However, even when the frequency of the AC component is changed, it is possible to obtain the substantially equal advantage effects. Further, the amplitude and the frequency of the AC component may be simultaneously changed.

Still further, in this embodiment, the example in which the calculation of the toner dispense time Dt based on the input-area-ratio counter integrated value C (see steps S13, S14 in FIG. 8) is performed in a last stage of the setup cycle. However, the order of steps is not limited to such an order and the operation may be performed in other order.

As described above, according to this embodiment, with respect to the change of the developer, the AC component of the developing bias is suitably changed based on the information of the measured volume resistivity information of the developer and hence, it is possible to preliminarily prevent the degradation of the image quality attributed to the change of the developer whereby it is possible to obtain the stable image quality over a long period.

Here, in this embodiment, the volume resistivity detecting device 46 and the controller 50 are provided separately. However, the volume resistivity detecting device 46 and the controller 50 may be integrally provided.

EXAMPLES

Example 1

This example is characterized in that the evaluation is made based on a monochromatic image using the image forming apparatus of the above-mentioned embodiment, wherein the relationship between the amplitude (the amplitude of the AC component of the developing bias) and the volume resistivity of the developer which can acquire the proper image when the printing is repeated is confirmed. Thereafter, the acquired relationship is formed into a table and advantageous effects are confirmed using a device which can perform the adjustment of the amplitude with respect to the volume resistivity. Here, specific conditions are determined as follows.

(1) Developer as Used

Mixed powder consisting of polymerized toner having an average particle size (d50) of 6 μm and carrier formed of ferrite particles to which a fluoric resin is applied by coating is used. Further, the initial volume resistivity RV is adjusted to $10^{10}\Omega\cdot$cm.

(2) Adjusting Method

Using the above-mentioned developer, the running of 20 kPV (20 k prints) which adopts patterns in which the image area ratio of the input images are changed is performed so as to obtain a correction table of Vpp.

At the time of starting the adjustment, the amplitude Vpp of the AC component of the developing bias is set to 600V and the frequency is set to 9 kHz. Further, a contrast between a non-image-portion potential (photoreceptor potential of the background portion) and the DC component VDC of the developing bias is set to 120V, and a contrast between the solid-image-portion potential (a photoreceptor potential of a matted portion) and the DC component of the developing bias is set to 300V.

Here, with respect to the outputted images, the amplitude of the AC component of the developing bias is changed and conditions which can maintain the proper image quality are obtained based on the subjective evaluation. Here, as image evaluation parameters which select the proper image quality, the following items are used.

Graininess: The outputted images are compared to each other with respect to the preference of graininess in an intermediate gray scale portion based on subjective evaluation.

Good: level at which graininess is inconspicuous

Fair: level at which although graininess is recognized, no problem arises in practical use Bad: level at which graininess is poor and hence, the developer cannot be used Fogging: The outputted images are compared to each other with respect to the degradation of image quality attributed to the fogging toner developed on a background portion based on subjective evaluation Good: level at which the presence of the fogging toner is not determined Fair: level at which although the fogging toner exists, the degradation of image quality is small and hence, there arises no problem in practical use Bad: level at which the fogging toner is apparent and the image quality is degraded and hence, the developer cannot be used BCO: The outputted images are compared to each other with respect to the degradation of image quality attributed to carrier transferred to the background portion and the high density portion based on subjective evaluation.

Good: level at which the presence of the transfer of the carrier is not determined Fair: level at which although the carrier is transferred, the degradation of image quality is small and hence, there arises no problem in practical use Bad: level at which the transfer of carrier is apparent and the image quality is degraded and hence, the developer cannot be used Edge emphasizing property: The outputted images are compared to each other with respect to the preference of an image when a matted image portion of 1×1 cm having an area ratio of 100% is formed at a center of a uniform intermediate gray scale image portion of 3×3 cm having an area ratio of 50% based on subjective evaluation.

Good: level at which the lowering of density of the intermediate gray scale portion around the matted portion is inconspicuous Fair: level at which although the lowering of density of the intermediate gray scale portion around the matted portion is recognized, there arises no problem in practical use Bad: level at which the lowering of density of the intermediate gray scale portion around the matted portion is conspicuous and hence, the developer cannot be used Banding: The outputted images are compared to each other with respect to the fluctuation of density in a developing roll cycle which appears in the intermediate gray scale portion based on subjective evaluation.

Good: level at which the presence of banding cannot be determined

Fair: level at which although the banding can be determined, there arises no problem in an actual use Bad: level at which the banding is conspicuous and hence, the developer cannot be used When the correction table of Vpp is obtained by performing the outputting of 20 kPV under the above-mentioned conditions, it is found that when the volume resistivity exceeds the RVmax by $\Delta\log RV(=\log RV-\log RVmax)$ or when the volume resistivity becomes lower than RVmax by $\Delta\log RV$, it is sufficient to use $Vpp'=r\times Vpp$ as Vpp' using a following correction coefficient r.

When the volume resistivity exceeds RVmax, as the correction coefficient r, a value which is obtained by $r=1+k1\times\Delta\log RV$ may be used, while when the volume resistivity becomes lower than RVmin, as the correction coefficient r, a value obtained by $r=1-k2\times\Delta\log RV$ may be used. Here, k1, k2 are proportional constants.

Further, it is also found that the upper and lower limit values of volume resistivity RVmax and RVmin are desirably set to $10^{11}\Omega\cdot cm$ and $10^{9}\Omega\cdot cm$ respectively.

Next, to confirm the validity of the obtained correction coefficients, among the above-mentioned proportional constants, by setting k1 as 0.2 and k2 as 0.1, the correction table which describes the relationship between the volume resistivity RV and the amplitude Vpp of the AC component of the developer is prepared, the correction table is stored in the controllers (for example, corresponding to the controllers 50 shown in FIG. 2) of three sets of devices, and the evaluations are performed under conditions substantially equal to the above-mentioned conditions. Here, the adjustment of the AC component of the developing bias is automatically performed from the controller side of the device. Further, in such evaluations, a setup cycle and a dispense time for one sheet are determined as follows.

(A) Setup cycle: The setup is performed at the time of supplying the power source or at the time of starting the job after the number of accumulated prints from the completion of setup of preceding time exceeds 30 sheets. Here, the density setup is performed in the inter image, and the potential setup is performed when the fixing device is turned off.

(B) Dispense time Dt per one sheet: The value which is obtained by adding the correction corresponding to the output value of the toner density sensor to the value which is obtained based on the toner consumption on the reference-area-ratio chart by taking the area ratio and the image size of the actual image into consideration (to be more specific, the value which is obtained by multiplying a ratio between the above-mentioned toner consumption and the area ratio and a ratio of the image size), that is, the dispense time necessary for replenishing the toner corresponding to an actual toner consumption.

When the output images of three sets of devices are suitably confirmed, it is confirmed that the favorable image quality can be maintained without changing the image density and the tone of color, without degrading the graininess, and eliminating fogs and carrier fogging.

Further, when the similar confirmation is performed by fixing the amplitude of the AC component Vpp at a fixed value for a comparison purpose, although the image density and the color tone are not largely changed, when the outputting exceeds 10 kPV and up to 1000 sheets (1 kPV) from the initial stage, the degradation of graininess is observed. Further, it is confirmed that the fogging is generated up to 500 sheets from the initial stage. Although there arises no problem up to several 10 sheets from a starting time, the fogging is generated thereafter.

This implies that when some sheets, for example, are outputted from the starting time, the toner replenishing quantity is reviewed in the setup cycle and the volume resistivity of the developer is largely increased. Here, according to this embodiment, the favorable image quality is maintained by adjusting the amplitude of the AC component of the developing bias in conformity with the change of the volume resistivity. It is estimated that, however, in the comparison examples, when the setup is performed with respect to the sharp change of the volume resistivity, the setup cannot follow the sharp change of the volume resistivity and hence, the image quality is affected.

Further, when the number of outputted sheets is increased, the volume resistivity of the developer is gradually changed and exceeds the given range and hence, it is difficult to maintain the favorable image quality in case of the comparison examples.

Further, when the evaluations similar to the above-mentioned evaluations are performed under a high temperature high-moisture environment, although the generation of problems is not confirmed under the conditions of the examples, the generation of carrier fogging is confirmed when the outputting exceeds 15 kPV in the comparison example.

Still further, when the adjustment based on the frequency of AC component of the developing bias is studied, by using Vpp/r as Vpp', it is confirmed that the substantially equal advantageous effects are obtained as in the case in which the amplitude of the AC component of the developing bias is adjusted. From the above, the validity of the present invention is appreciated. Further, there arises no problem even when the amplitude and the frequency of the AC component of the developing bias are simultaneously adjusted.

Although the evaluations are confirmed with respect to the monochromatic images to perform the evaluation of image quality in detail in the examples, it is needless to say that the favorable image quality can be maintained by controlling the respective developing biases as described above with respect to the color image.

Example 2

Image forming apparatus: The apparatus of the example 1 is used.

Carrier: Spherical ferrite particles having a particle size of 35 μm are covered with a mixed material consisting of a fluororesin, an acrylic resin and carbon fine particles. By changing an amount of the carbon fine particles, carriers having the volume resistivity values of $10^{7}$, $10^{9}$, $10^{11}$, $10^{13}$, $10^{15}\Omega\cdot cm$ are obtained.

Here, the above-mentioned carrier resistance ($\Omega\cdot cm$) is measured as follows. The measuring environment is set such that the temperature is 20° C. and the humidity is 50% RH. On a surface of a circular jig which arranges an electrode plate having an area of 20 $cm^2$ is arranged, the carrier which becomes an object to be measured is placed thus forming a flat carrier layer having a thickness of approximately 1 to 3 mm. An electrode plate having an area of 20 $cm^2$ in the same manner as the above-mentioned electrode plate is placed on the carrier layer thus sandwiching the carrier layer with two electrode plates. To eliminate a gap between the carriers, a weight of 4 kg is applied to the electrode plate which is placed on the carrier layer and a thickness (mm) of the carrier layer is measured. Both upper and lower electrodes of the carrier layer are connected with an electrometer and a high-voltage power source generating device. A high voltage is applied to both electrodes such that an electric field of 103.8V/cm is generated and the carrier resistance (Ω·cm) is calculated by reading a current value (A) which flows at this point of time. A calculation formula of the carrier resistance (Ω·cm) is expressed by a following formula (1).

$$R=E\times 20/(I-I0)/L \quad \text{formula (1)}$$

In the formula, R indicates the carrier resistance (Ω·cm) E indicates the applied voltage (V), I indicates the current value (A), I0 indicates the current value (A) when the applied voltage is 0V, L indicates the thickness (mm) of the carrier layer. Further, the coefficient 20 indicates the area ($cm^2$) of the electrode plate.

Toner: carbon pigment is mixed into a polyester resin and mixing by melting, mechanical pulverizing and pneumatic classification are performed to produce black toner mother particles having an average volume particle size of 7 μm. By exteriorly adhering titanium dioxide and silica particles on surfaces of the mother particles, black toner is obtained.

Developer: the above-mentioned toner is mixed to the above-mentioned carrier at a rate of 6 weight % thus obtaining a black developer.

In using the above-mentioned apparatus and the developer, the frequency of the AC component of the developing bias is set to 6 kHz, the contrast between the photoreceptor potential of the background portion and the DC component of the developing biases is set to 120V, and the image is outputted by changing the amplitude Vpp of the AC component of the developing bias. Then, the graininess, the background fogging, BCO, the edge emphasizing property and the banding of the outputted images are inspected. Here, with respect to the respective conditions, an exposure amount to the photoreceptor is adjusted such that the developing weight density of the matted portion becomes 7 $gm/m^2$. Further, after outputting the images, the volume resistivity value of the developer is measured.

Here, the volume resistivity value of the developer in this example is measured by a following method.

In FIG. 3, numeral 46*a* indicates a conductive plate which has a curvature equal to a curvature of the developing roll 42 to conform to the curvature of the developing roll 42, a developing-roll-directional length of 10 cm, a nip width of 2 cm and a nip area of 20 $cm^2$. The conductive plate 46*a* is arranged downstream of a developer layer restricting member (trimmer 43). At the time of measuring the resistance, the rotation of the developing roll is stopped and the conductive plate 46*a* is brought into contact with the developing roll 42 to nip the developing roll 42 by way of the developer layer. Here, a gap defined between the conductive plate 46*a* and developing roll 42 is adjusted to become 0.06 cm. In this manner, the volume resistivity value of the developer layer in a state that the developer layer is formed can be measured. The conductive plate 46*a* and the developing roll 42 are connected to an electrometer and a high-voltage power source generating device. A high voltage is applied to both electrodes such that an electric field of 50V/cm is generated and the carrier resistance (Ω·cm) is calculated by reading a current value (A) which flows at this point of time. A calculation formula of the carrier resistance (Ω·cm) is expressed by a following formula (1).

$$R=E\times 20/(I-I0)/L \quad \text{formula (1)}$$

In the formula, R indicates the carrier resistance (Ω·cm), E indicates the applied voltage (V), I indicates the current value (A), I0 indicates the current value (A) when the applied voltage is 0V, L indicates the thickness (cm) of the carrier layer. Further, the coefficient 20 indicates the area ($cm^2$) of the electrode plate.

In the usual copying operation, the conductive plate 46*a* is retracted to prevent the conductive plate 46*a* from disturbing the developer layer.

In this example, the carrier resistance value measured in the above-mentioned manner is used as the volume resistivity value of the developer layer.

The evaluation criteria of the image are substantially equal to the evaluation criteria of example 1.

In evaluating the outputted images, first of all, the conditions marked with "BAD" with respect to the above-mentioned evaluation items are eliminated, and the conditions with large number of "Good" are set as the optimum condition. As a result, the optimum Vpp with respect to the carrier resistance value and the volume resistivity of the developer at the optimum Vpp become as follows (Table 1 and FIG. 9).

TABLE 1

| | | | | | |
|---|---|---|---|---|---|
| Carrier resistance value (□ cm) | $10^7$ | $10^9$ | $10^{11}$ | $10^{13}$ | $10^{15}$ |
| Vpp (kHV) | 0.4 | 0.6 | 1.0 | 1.2 | 1.5 |
| Developer volume resistivity value (□ cm) | $10^8$ | $10^{11}$ | $10^{13}$ | $10^{14}$ | $10^{15}$ |

Next, the developer which is produced by mixing the above-mentioned toner into the carrier having the volume resistivity value of the $10^9$Ωcm at a ratio of 8 weight % is filled in the above-mentioned device and using a business document having respective color average area ratio of approximately 5% as a pattern, the image outputting of 40 k prints in total is performed. The volume resistivity value of the developer (material obtained by mixing toner and carrier) is measured at timings of initial stage, 500 sheets, 1 k, 2 k, 5 k, 10 k, 20 k, 40 k. Here, the frequency and the amplitude of the AC component of the developing bias are set to 6 kHz and 0.6 kV respectively. As a result, the change of the volume resistivity value of the developer becomes as follows.

TABLE 2

| | Prints number | | | | | | | |
|---|---|---|---|---|---|---|---|---|
| | Initial | 500 | 1k | 2k | 5k | 10k | 20k | 40k |
| Volume resistivity value (Ωcm) | $10^{14}$ | $10^{13}$ | $10^{12}$ | $5\times10^{11}$ | $10^{11}$ | $5\times10^{10}$ | $5\times10^{9}$ | $10^{9}$ |

Figure 9:
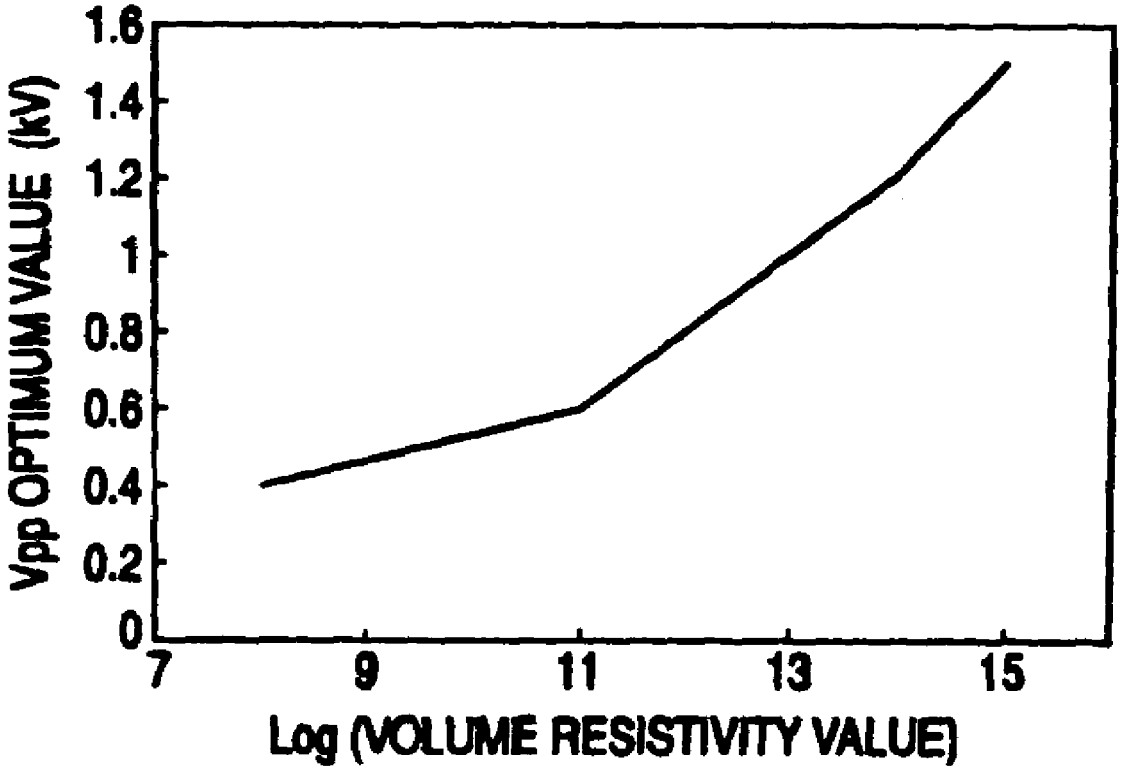
FIG. 9 is a graph showing the relationship between an optimum Vpp value and a volume resistivity value.
Figure 10:
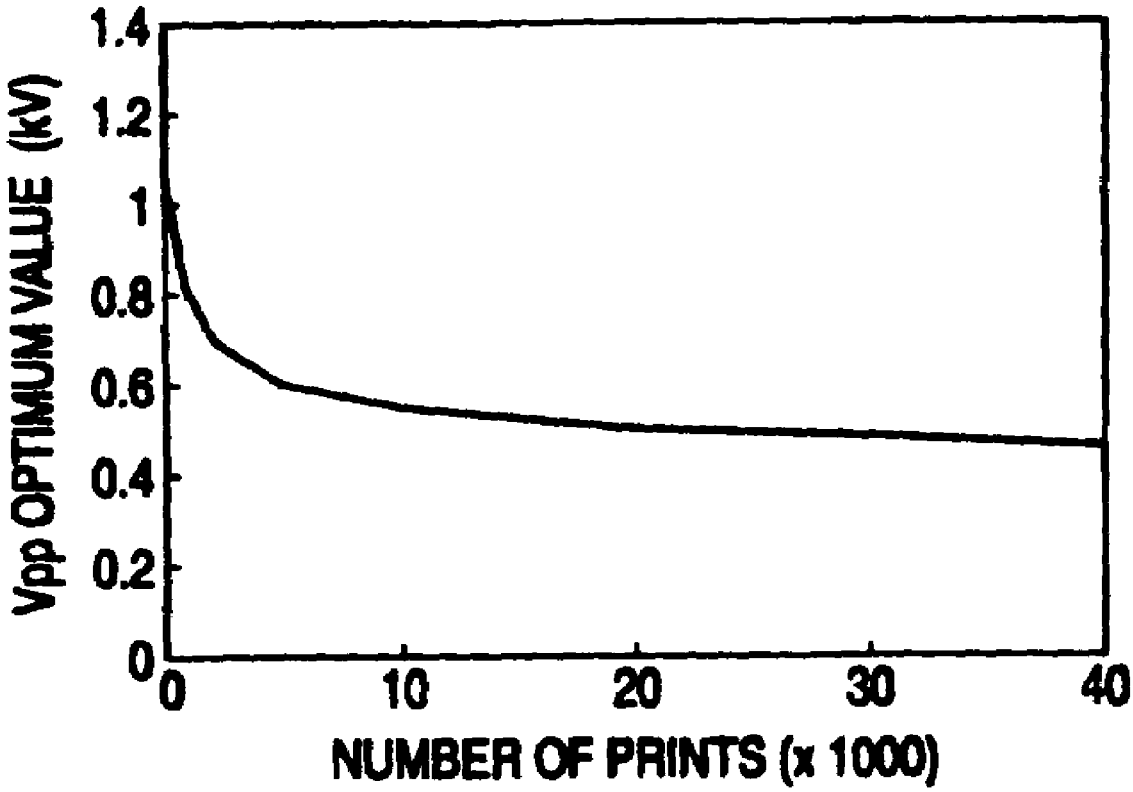
FIG. 10 is a graph showing the relationship between an optimum Vpp value and the number of prints.

The optimum amplitude Vpp of the AC component of the developing bias for every number of prints which are obtained by combining Table 2 and FIG. 9 becomes as shown in FIG. 10.

A function indicative of the relationship between the optimum amplitude Vpp of the AC component of the developing bias obtained in view of the volume resistivity value of the developer and the number of prints is prepared and the function is stored in an optimum Vpp calculating unit.

The frequency of the AC component of the developing bias is fixed to 6 kHz using the device of example 1, while amplitude of the AC component of the developing bias is changed using the Vpp calculating unit. 40 k continuous print outputting is performed by three sets of devices and the change of image quality is inspected. Here, a business document having an average area ratio of approximately 5% for every color is used in the pattern.

Here, the image density is evaluated as follows.

Image density: The outputted images are compared to each other with respect to the density of a high concentration portion based on subjective evaluation.

Good: level at which the image density is sufficiently high.

Fair: level at which although the image density is slightly low but there arises no problem in practical use.

Bad: level at which the image density is low and the developer cannot be used.

Example 3

Image forming apparatus: the apparatus of example 1 is used

Carrier: spherical ferrite particles having a particle size of 35 μm are covered with a mixed material consisting of a fluororesin, an acrylic resin and carbon fine particles. The carrier having the volume resistivity value of $10^{12}$Ωcm is obtained.

Toner: Toner equal to the toner used in example 1 is used.

Developer: the above-mentioned toner is mixed to the carrier at a ratio of 8 weight % thus obtaining the black developer.

The above-mentioned developer is filled in the above-mentioned device and using a business document having respective color average area ratio of approximately 5% as a pattern, the image outputting of 40 k prints in total is performed. The volume resistivity value of the developer (material obtained by mixing toner and carrier) is measured at timings of initial stage, 500 sheets, 1 k, 2 k, 5 k, 10 k, 20 k, 40 k. Here, the frequency and the amplitude of the AC component of the developing bias are set to 6 kHz and 1.0 kV respectively. As a result, the change of the volume resistivity value of the developer becomes as follows.

TABLE 3

| | Prints number | | | | | | | |
|---|---|---|---|---|---|---|---|---|
| | Initial | 500 | 1k | 2k | 5k | 10k | 20k | 40k |
| Volume resistivity value (Ωcm) | $10^{15}$ | $10^{14}$ | $10^{13}$ | $5 \times 10^{12}$ | $10^{12}$ | $10^{11}$ | $5 \times 10^{10}$ | $10^{10}$ |

Figure 11:
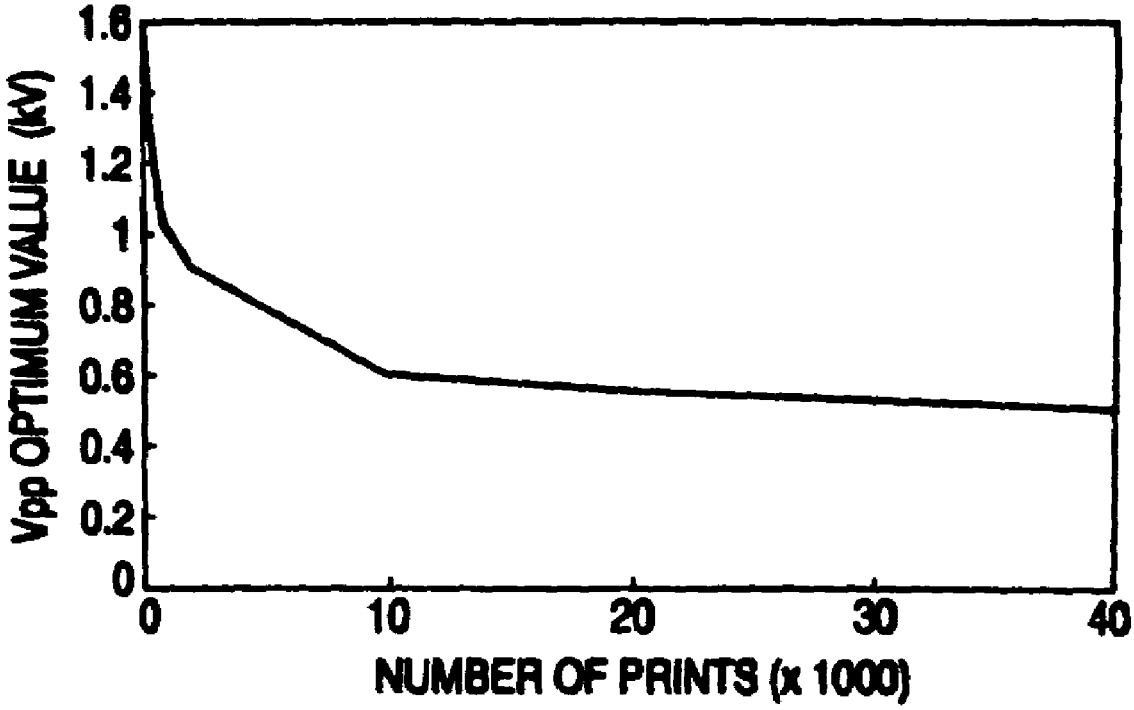
FIG. 11 is a graph showing the relationship between an optimum Vpp value and the number of prints.

The optimum amplitude Vpp of the AC component of the developing bias for every number of prints which are obtained by combining Table 3 and FIG. 10 becomes as shown in FIG. 11.

A function indicative of the relationship between the optimum amplitude Vpp of the AC component of the developing bias obtained based on the volume resistivity value of the developer and the number of prints is prepared and the function is stored in the optimum Vpp calculating unit.

The frequency of the AC component of the developing bias is fixed to 6 kHz using the device of example 1, while the amplitude of the AC component of the developing bias is changed using the Vpp calculating unit. 40 k continuous print outputting is performed by three sets of devices and the change of image quality is inspected. Here, a business document having an average area ratio of approximately 5% for every color is used in the pattern.

Example 4

Image forming apparatus: the apparatus of example 1 is used.

Carrier: spherical ferrite particles having a particle size of 35 μm are covered with a mixed material consisting of a fluororesin and an acrylic resin. The carrier having the volume resistivity value of $10^{15}$Ωcm is obtained.

Toner: Toner equal to the toner used in example 1 is used.

Developer: the above-mentioned toner is mixed to the carrier at a ratio of 8 weight % thus obtaining the black developer.

The above-mentioned developer is filled in the above-mentioned device and using a business document having respective color average area ratio of approximately 5% as a pattern, the image outputting of 40 k prints in total is performed. The volume resistivity value of the developer (material obtained by mixing toner and carrier) is measured at timings of initial stage, 500 sheets, 1 k, 2 k, 5 k, 10 k, 20 k, 40 k. Here, the frequency and the amplitude of the AC component of the developing bias are set to 6 kHz and 1.5 kV respectively. As a result, the change of the volume resistivity value of the developer becomes as follows.

TABLE 4

| | Prints number | | | | | | | |
|---|---|---|---|---|---|---|---|---|
| | Initial | 500 | 1k | 2k | 5k | 10k | 20k | 40k |
| Volume resistivity value (Ωcm) | $10^{15}$ | $10^{15}$ | $10^{15}$ | $10^{15}$ | $5 \times 10^{14}$ | $10^{14}$ | $10^{13}$ | $10^{12}$ |

Figure 12:
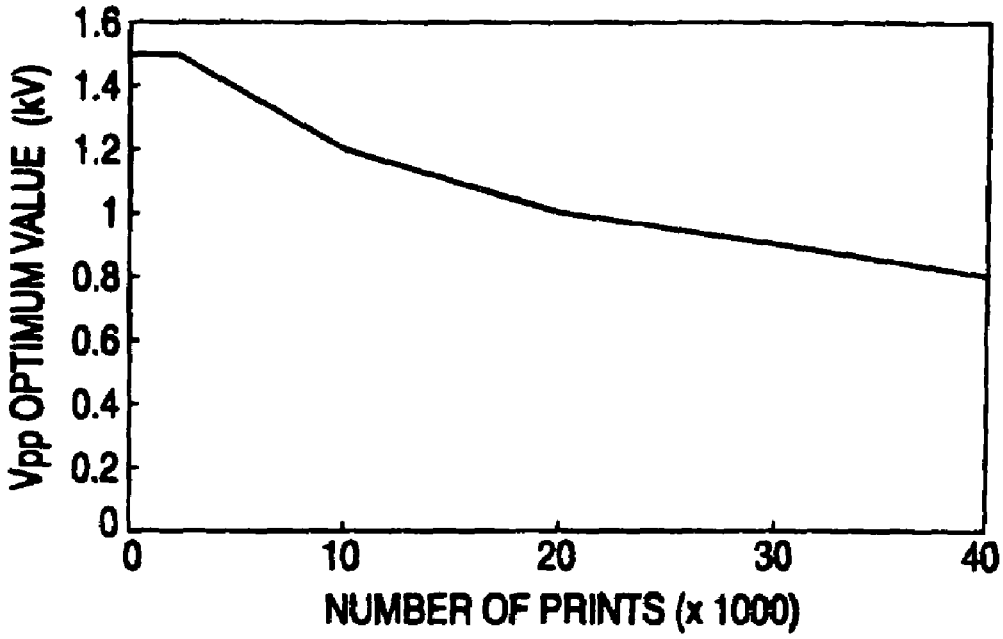
FIG. 12 is a graph showing the relationship between an optimum Vpp value and the number of prints.

The optimum amplitude Vpp of the AC component of the developing bias for every number of prints which are obtained by combining Table 4 and FIG. 11 becomes as shown in FIG. 12.

A function indicative of the relationship between the optimum amplitude Vpp of the AC component of the developing bias and the number of prints obtained based on the volume resistivity value of the developer is prepared and the function is stored in the optimum Vpp calculating unit.

The frequency of the AC component of the developing bias is fixed to 6 kHz using the device of example 1, while amplitude of the AC component of the developing bias is changed using the Vpp calculating unit. 40 k continuous print outputting is performed by three sets of devices and the change of image quality is inspected. Here, a business document having an average area ratio of approximately 5% for every color is used in the pattern.

Example 5

Image forming apparatus: The apparatus of example 1 is used.

Carrier: spherical ferrite particles having a particle size of 35 μm are covered with a mixed material consisting of a fluororesin, an acrylic resin and carbon fine particles. By changing an amount of the carbon fine particles, carriers having the volume resistivity values of $10^7$, $10^9$, $10^{11}$, $10^{13}$, $10^{15}$Ω·cm are obtained.

Toner: Black toner equal to the toner used in example 1 is used.

Developer: the above-mentioned toner is mixed to the carrier at a ratio of 6 weight % thus obtaining the black developer.

In using the above-mentioned apparatus and the developer, the amplitude Vpp of the AC component of the developing bias is set to 1.0 KV, the contrast between the photoreceptor potential of the background portion and the DC component of the developing biases is set to 120V, and the image is outputted by changing the frequency of the AC component of the developing bias. Then, the graininess, the background fogging, BCO, the edge emphasizing property and the banding of the outputted images are inspected. Here, with respect to the respective conditions, an exposure amount to the photoreceptor is adjusted such that the developing weight density of the matted portion becomes 7 gm/$m^2$. Further, after outputting the images, the volume resistivity value of the developer is measured.

In evaluating the outputted images, first of all, the conditions marked with "BAD" with respect to the above-mentioned evaluation items are eliminated, and the conditions with large number of "Good" are set as the optimum condition. As a result, the optimum frequency and the volume resistivity of the developer at the optimum frequency with respect to the carrier resistance value become as follows (Table 5 and FIG. 13).

TABLE 5

| | | | | | |
|---|---|---|---|---|---|
| Carrier resistance value (□ cm) | $10^7$ | $10^9$ | $10^{11}$ | $10^{13}$ | $10^{15}$ |
| Frequency (kHz) | 12 | 8 | 6 | 4 | 2 |
| Developer volume resistivity value (□ cm) | $10^8$ | $10^{11}$ | $10^{13}$ | $10^{14}$ | $10^{15}$ |

Next, the developer which is produced by mixing the above-mentioned toner into the carrier having the volume resistivity value of the $10^9$ Ωcm at a ratio of 8 weight % is filled in the above-mentioned device and using a business document having respective color average area ratio of approximately 5% as a pattern, the image outputting of 40 k prints in total is performed. The volume resistivity value of the developer (material obtained by mixing toner and carrier) is measured at timings of initial stage, 500 sheets, 1 k, 2 k, 5 k, 10 k, 20 k, 40 k. Here, the frequency and the amplitude of the AC component of the developing bias are set to 6 kHz and 1.0 kV respectively. As a result, the change of the volume resistivity value of the developer becomes as follows.

TABLE 6

| | Prints number | | | | | | | |
|---|---|---|---|---|---|---|---|---|
| | Initial | 500 | 1k | 2k | 5k | 10k | 20k | 40k |
| Volume resistivity value (Ωcm) | $10^{14}$ | $10^{13}$ | $10^{12}$ | $5 \times 10^{11}$ | $10^{11}$ | $5 \times 10^{10}$ | $5 \times 10^9$ | $10^9$ |

Figure 13:
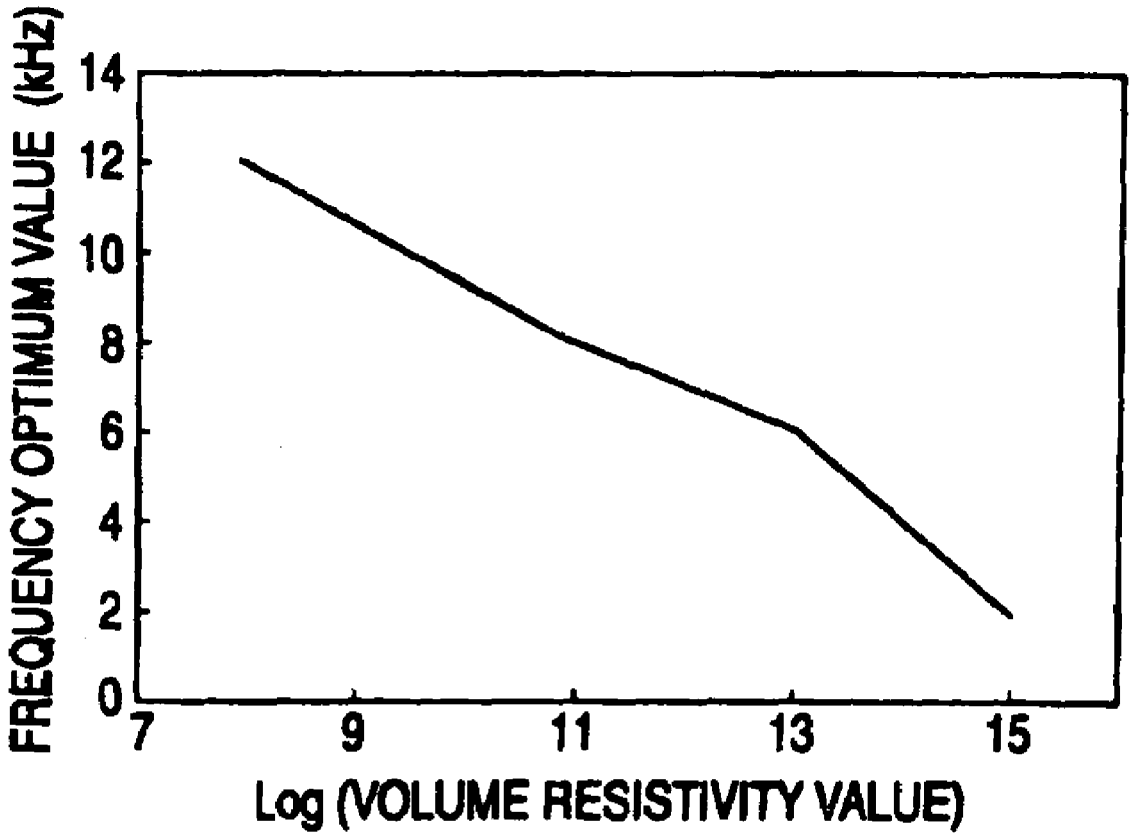
FIG. 13 is a graph showing the relationship between a frequency optimum value and a volume resistivity value.
Figure 14:
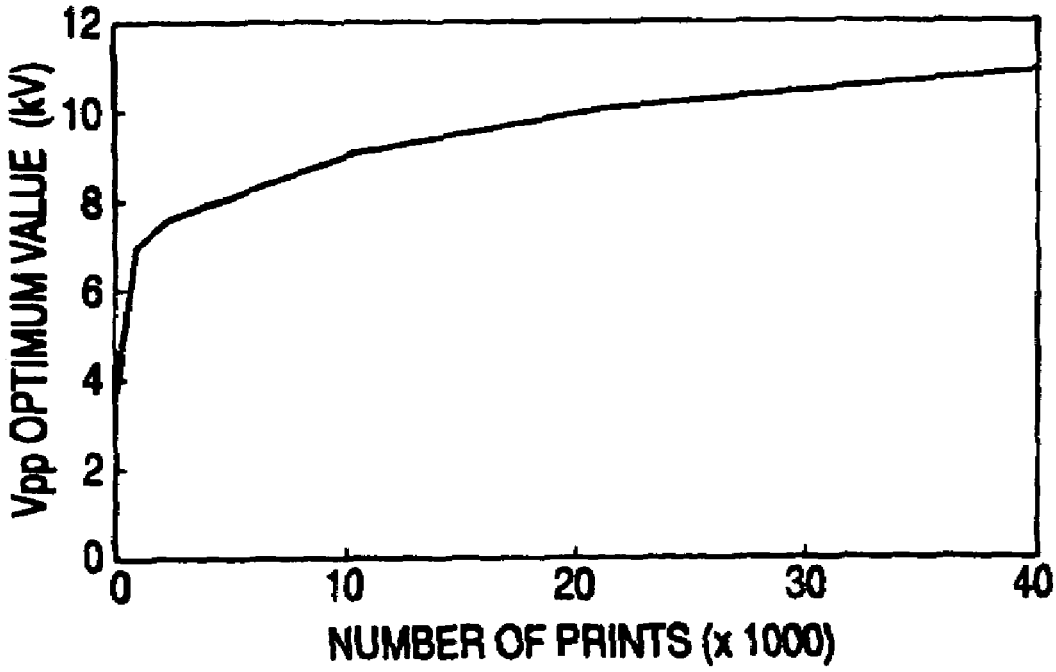
FIG. 14 is a graph showing the relationship between an optimum Vpp value and the number of prints.

The optimum amplitude Vpp of the AC component of the developing bias for every number of prints which are obtained by combining Table 6 and FIG. 13 becomes as shown in FIG. 14.

A function indicative of the relationship between the optimum frequency of the AC component of the developing bias and the number of prints obtained based on the volume resistivity value of the developer is prepared and the function is stored in an optimum frequency calculating unit.

The amplitude of the AC component of the developing bias is fixed to 1.0 KV using the device of example 1, while frequency of the AC component of the developing bias is changed using the optimum frequency calculating unit. 40k continuous print outputting is performed by three sets of devices and the change of image quality is inspected. Here, a business document having an average area ratio of approximately 5% for every color is used in the pattern.

Comparison Example 1

Image forming apparatus: The apparatus of example 1 is used.

Carrier: spherical ferrite particles having a particle size of 35 μm are covered with a mixed material consisting of a fluororesin, an acrylic resin and carbon fine particles. The carrier having the volume resistivity value of $10^9$Ωcm is obtained.

Toner: Toner equal to the toner used in example 1 is used.

Developer: the above-mentioned toner is mixed to the carrier at a ratio of 8 weight % thus obtaining the black developer.

Using the developer and three sets of devices which sets the amplitude and the frequency of the AC component of the developing bias to 1.2 KV and 6 kHz, 40 k continuous print outputting is performed respectively and the change of image quality is inspected. Here, a business document having an average area ratio of approximately 5% for every color is used in the pattern.

Comparison example 2

Image forming apparatus: The apparatus of example 1 is used.

Carrier: spherical ferrite particles having a particle size of 35 μm are covered with a mixed material consisting of a fluororesin, an acrylic resin and carbon fine particles. The carrier having the volume resistivity value of $10^{12}$Ωcm is used.

Toner: Toner equal to the toner used in example 1 is used.

Developer: the above-mentioned toner is mixed to the carrier at a ratio of 8 weight % thus obtaining the black developer.

Using the developer and three sets of devices which sets the amplitude and the frequency of the AC component of the developing bias to 1.2 KV and 6 kHz, 40 k continuous print outputting is performed respectively and the change of image quality is inspected. Here, a business document having an average area ratio of approximately 5% for every color is used in the pattern.

Comparison example 3

Image forming apparatus: The apparatus of example 1 is used.

Carrier: spherical ferrite particles having a particle size of 35 μm are covered with a mixed material consisting of a fluororesin, an acrylic resin and carbon fine particles. The carrier having the volume resistivity value of $10^{15}$ Ωcm is used.

Toner: Toner equal to the toner used in example 1 is used.

Developer: the above-mentioned toner is mixed to the carrier at a ratio of 8 weight % thus obtaining the black developer.

Using the developer and three sets of devices which sets the amplitude and the frequency of the AC component of the developing bias to 1.2 KV and 6 kHz, 40 k continuous print outputting is performed respectively and the change of image quality is inspected. Here, a business document having an average area ratio of approximately 5% for every color is used in the pattern.

Comparison Example 2

Image forming apparatus: The apparatus of the example 1 is used.

Carrier: spherical ferrite particles having a particle size of 35 μm are covered with a mixed material consisting of a fluororesin, an acrylic resin and carbon fine particles. The carrier having the volume resistivity value of $10^{12}$ Ωcm is used.

Toner: Toner equal to the toner used in the example 1 is used.

Developer: the above-mentioned toner is mixed to the carries at a ratio of 8 weight % thus obtaining the black developer.

Using the developer and three sets of devices which sets the amplitude and the frequency of the AC component of the developing bias to 1.2 KV and 6 kHz, 40 k continuous print outputting is performed respectively and the change of image quality is inspected. Here, a business document having an average area ratio of approximately 5% for every color is used in the pattern.

Comparison Example 3

Image forming apparatus: The apparatus of the example 1 is used.

Carrier: spherical ferrite particles having a particle size of 35 μm are covered with a mixed material consisting of a fluororesin, an acrylic resin and carbon fine particles. The carrier having the volume resistivity value of $10^{15}$ Ωcm is used.

Toner: Toner equal to the toner used in the example 1 is used.

Developer: the above-mentioned toner is mixed to the carries at a ratio of 8 weight % thus obtaining the black developer.

Using the developer and three sets of devices which sets the amplitude and the frequency of the AC component of the developing bias to 1.5 KV and 6 kHz, 40 k continuous print outputting is performed respectively and the change of image quality is inspected. Here, a business document having an average area ratio of approximately 5% for every color is used in the pattern.

The result of image quality maintaining properties of the examples and the comparison examples are shown in Table 7. The image quality evaluation result is an average of image quality evaluation results obtained with respect to three sets of devices.

From the above results of examples and comparison examples, it is clearly understood that the devices of the examples satisfy all image quality items in a balanced manner. On the other hand, the devices of the comparison examples cannot satisfy some image qualities at the initial stage or along with the lapse of time.

TABLE 7

| | Number of Cycles | Graininess | Image Density | BCO | Fogging | Edge emphasizing property | Banding |
|---|---|---|---|---|---|---|---|
| Example 2 | Initial | Good | Good | Good | Good | Good | Good |
| | 5K | Good | Good | Good | Good | Good | Good |
| | 40K | Fair | Good | Fair | Good | Good | Good |
| Example 3 | Initial | Good | Good | Good | Good | Good | Fair |
| | 5K | Good | Good | Good | Good | Good | Good |
| | 40K | Fair | Good | Good | Good | Fair | Good |
| Example 4 | Initial | Good | Good | Good | Good | Fair | Good |
| | 5K | Good | Good | Good | Good | Fair | Fair |
| | 40K | Fair | Fair | Good | Good | Fair | Fair |
| Example 5 | Initial | Good | Good | Good | Good | Good | Good |
| | 5K | Good | Good | Good | Good | Good | Good |
| | 40K | Fair | Fair | Fair | Good | Good | Good |
| Comparison example 1 | Initial | Fair | Good | Good | Good | Good | Good |
| | 5K | Bad | Good | Good | Good | Good | Good |
| | 40K | Bad | Good | Bad | Bad | Good | Good |

TABLE 7-continued

| | Number of Cycles | Graininess | Image Density | BCO | Fogging | Edge emphasizing property | Banding |
|---|---|---|---|---|---|---|---|
| Comparison example 2 | Initial | Good | Fair | Good | Good | Fair | Fair |
| | 5K | Fair | Good | Good | Good | Good | Good |
| | 40K | Bad | Good | Bad | Good | Fair | Good |
| Comparison example 3 | Initial | Fair | Good | Good | Good | Fair | Fair |
| | 5K | Good | Good | Good | Good | Bad | Fair |
| | 40K | Bad | Fair | Bad | Bad | Fair | Fair |

As described above, some embodiments of the invention are outlined below.

According to an aspect of the present invention, a developing device comprises: a developing housing that faces an image carrier on which an electrostatic latent image is carried and stores a developer which contains toner and magnetic carrier is housed in; a developer carrier that is disposed apart from the image carrier in the developing housing and carries and transports the developer; a developing bias applying unit that is disposed between the image carrier and the developer carrier and applies a developing bias for developing the electrostatic latent image on the image carrier, the developing bias comprising an AC component and a DC component, the AC component being superposed to a DC component; a volume resistivity detecting unit that detects a volume resistivity of the developer on the developer carrier; and a developing bias adjusting unit that sets the AC component of the developing bias to a reference value when the volume resistivity of the developer detected by the volume resistivity detecting unit falls within a given range, and corrects the AC component of the developing bias to cause an image quality evaluation parameter to fall within an allowable range when the volume resistivity of the developer exceeds the given range.

Figure 1:
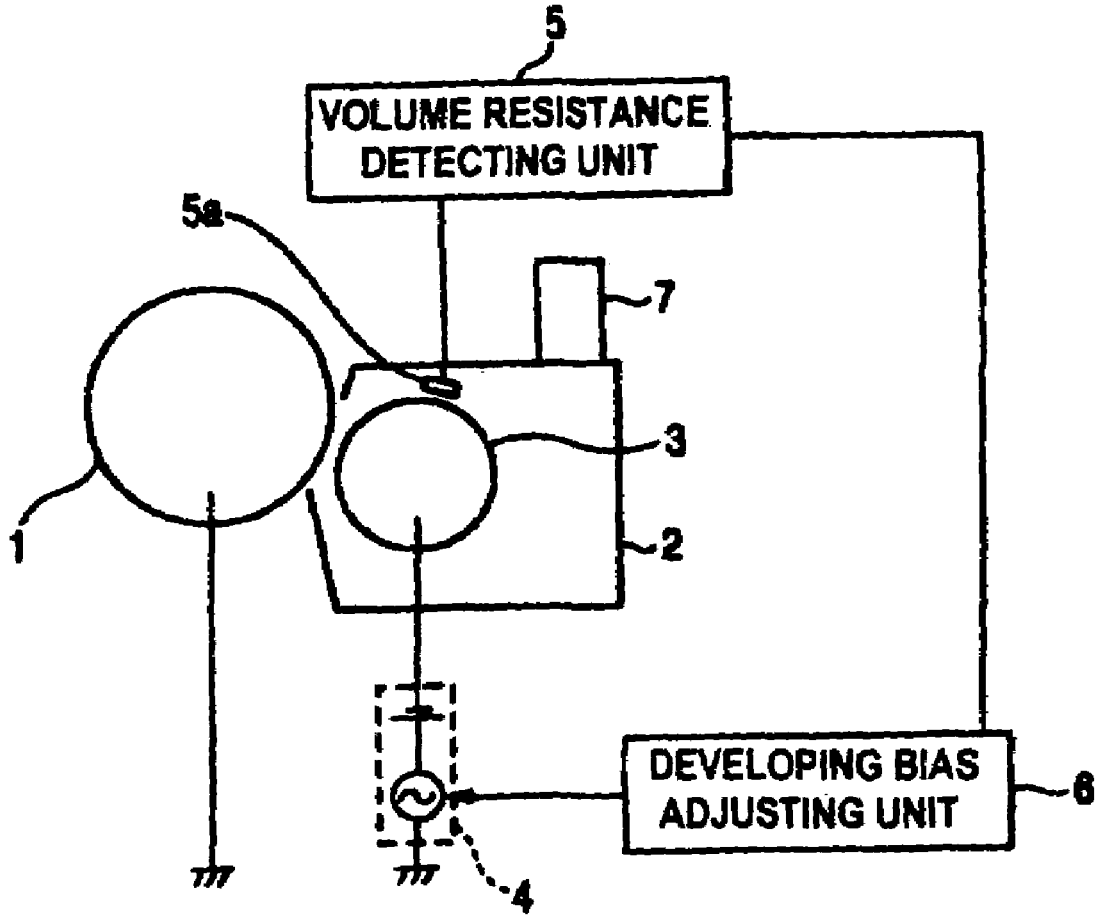
FIG. 1 is an explanatory view showing a schematic structure of the a developing device according to the present invention.

As shown in FIG. 1, a developing device according to an aspect of the invention includes a developing housing 2 which is arranged to face an image carrier 1 on which an electrostatic latent image is carried and in which two-component developer (developer) which contains toner and magnetic carrier is housed, a developer carrier 3 which is arranged in a spaced-apart manner from the image carrier 1 in the inside of the developing housing 2 and carries and transports the developer which develops the electrostatic latent image on the image carrier 1, a developing bias applying unit 4 which is interposed between the image carrier 1 and the developer carrier 3 and applies a developing bias on which an AC component is superposed to a DC component for developing the electrostatic latent image on the image carrier 1, a volume resistivity detecting unit 5 which detects a volume resistivity of the developer on the developer carrier 3, and a developing bias adjusting unit 6 which sets the AC component of the developing bias to a reference value when the volume resistivity of the developer which is detected by the volume resistivity detecting unit 5 falls within a given range, and corrects the AC component of the developing bias such that an image quality evaluation parameter falls within an allowable range when the volume resistivity of the developer exceeds the given range.

In such a technical unit, since a developing method according to an aspect of the present invention is of a type which uses a two-component developer (developer), it is possible to use toner which includes various color components. For example, not to mention that the present invention is applicable to a developing method which is used in a monochromatic image forming apparatus which uses a monochromatic developing device, the present invention is also applicable to a developing method which is used in a full-color image forming apparatus which uses plural developing devices.

Further, provided that the developer carrier 3 is arranged in a spaced-apart manner from the image carrier 1, as the moving directions of the developer carrier 3 and the image carrier 1, it is possible to adopt either one of the against direction (moving in the directions opposite to each other at the relatively opposing positions) and the with direction (moving in the same direction at the relatively opposed positions).

Further, it is sufficient that the image carrier 1 can carry the electrostatic latent image and hence, either one of a roll shape and a belt shape may be adopted as a shape of the image carrier 1.

Still further, it is sufficient that the developer carrier 3 can carry and transport the developer and, as a typical mode, the developer carrier 3 is constituted of a rotatable non-magnetic sleeve and a magnetic body which is fixedly arranged in the inside of the non-magnetic sleeve.

It is sufficient that the volume resistivity detecting unit 5 of the present invention can detect the volume resistivity of the developer. Although the detecting position is not particularly limited, it is preferable to detect the volume resistivity on the developer carrier 3 where the developer maintains a fixed layer thickness. Here, the reason that the term "volume resistivity" is used is that the volume resistivity does not imply a usual volume resistivity rate but implies a detected resistance value per se of the developer under a specified condition (under the detecting condition) or a resistance value which is calculated based on the resistance value.

Here, "given range" of the volume resistivity implies a range which does not reach a region where an image defect such as fogging, carrier fogging (BCO: Bead Carrier Over) or the like occurs due to the volume resistivity. Usually, when the volume resistivity becomes excessively high, the degradation of image is generated due to fogging, graininess, banding or the like, while when the volume resistivity becomes excessively low, the image degradation such as carrier fogging, graininess or the like is generated.

Further, according to another aspect of the present invention, the volume resistivity detecting unit 5 includes a retractable electrode member 5*a* which contacts with the developer on the developer carrier 3 and the volume resistivity of the developer is detected between the electrode member 5*a* and the developer carrier 3.

As shown in FIG. 1, the volume resistivity detecting unit 5 includes a retractable electrode member 5*a* which is brought into contact with the developer on the developer carrier 3 and the volume resistivity of the developer is detected between the developer carrier 3 and the electrode member 5*a*. With the use of such an electrode member 5*a*, it is possible to detect the stable volume resistivity of the developer on the developer carrier 3 on which the developer having a uniform layer thickness is formed and, at the same time, it is possible to properly detect the volume resistivity of the developer thus reducing the influence on the developer. Here, the arrangement position of the electrode member 5*a* may be set on an upstream side, in the transporting direction of the developer, of the developing region where the developer carrier 3 and the image carrier 1 face each other and faces the developer on the developer carrier 3.

Further, "image evaluation parameters" imply the above-mentioned fogging, carrier fogging, graininess, banding, image density, edge emphasizing property and the like. Although it may be sufficient to use at least one evaluation item out of these evaluation items, it is desirable to evaluate plural image evaluation parameters simultaneously from a view point of further enhancing the high image quality. Further, it is desirable that the AC component of the developing bias is corrected using all image evaluation parameters.

Further, according to another aspect of the present invention, the developing bias adjusting unit 6 corrects the AC component of the developing bias based on a correction condition which is obtained beforehand. In FIG. 1, it is sufficient that the developing bias adjusting unit 6 can correct the AC component of the developing bias. Further, from a view point of obtaining a further favorable image, it is desirable that the developing bias adjusting unit 6 corrects the AC component of the developing bias based on correction conditions which are preliminarily obtained. For example, a mode in which the developing bias adjusting unit 6 adjusts the developing bias based on a correction table, a mode in which the developing bias adjusting unit 6 adjusts the developing bias based on an arithmetic formula and the like are named. Here, the correction conditions which are preliminarily obtained imply correction conditions which are obtained to acquire a favorable image in view of the correlation between the AC component of the developing bias obtained by the same type of device and the image quality evaluation parameters.

Further, according to another aspect of the present invention, the developing bias adjusting unit 6 corrects at least either one of an amplitude or a frequency of the developing bias AC component. In figure 6, it is desirable that the developing bias adjusting unit 6 corrects at least one of amplitude and frequency of the developing bias AC component. By correcting only one of the amplitude and the frequency, a control of the developing bias can be simplified and hence the simplification of the device per se can be effectively performed.

Still further, according to another aspect of the present invention, the developing device may further comprises an image density detecting unit that detects an image density of an image visualized by toner in the developer, and a controller that adjusts a developing condition except for the AC component of the developing bias based on information from the image density detecting unit. Here, timing at which the adjustment of the image forming conditions is performed by the controller and timing at which the correction of the developing bias is performed by the developing bias adjusting unit 6 are not particularly limited and the adjustment and the correction may be performed at any timing. However, from a viewpoint that the AC component of the developing bias is effectively corrected along the volume resistivity of the developer which is detected by the volume resistivity detecting unit 5 and, further, the image density is held at a fixed value as desired, it is desirable that the adjustment of the image forming conditions by the controller is performed after the adjustment by the developing bias adjusting unit 6 is performed.

Further, it is sufficient that the image density detecting unit detects the density of an image visualized by developing, wherein an image to be detected may be either one of the image on the image carrier 1 and the image which is transferred onto a recording medium (including an intermediate transfer body) from the image carrier 1, for example.

Further, it is sufficient that the image forming conditions referred here are conditions other than the AC component of the developing bias and may include the DC component of the developing bias and various potential conditions of the image carrier 1. Still further, in a mode in which the developing device includes a developer replenishing unit 7 (described later), the developer replenishing unit 7 may be controlled. Further, the image forming conditions may be specifically adjusted based on the information from the image density detecting unit and a parameter table which is preliminarily obtained, for example.

Still further, it is sufficient that the controller can adjust the image forming conditions in general and there exists no problem in including the developing bias adjusting unit 6 in the controller.

Further, according to another aspect of the present invention, the developing device comprises the developer replenishing unit 7 that replenishes a new developer to the inside of the developing housing 2, wherein an operation period of the developer replenishing unit 7 is set based on the accumulated information of the outputted images. According to the developing device described above, the developer replenishing unit 7 replenishes the new developer to the inside of the developing housing 2 for compensating for the consumption of toner due to outputted images. It is desirable that an operation period of the developer replenishing unit 7 is set based on the accumulated information of the outputted images. In this case, the replenishment of the developer from the developer replenishing unit 7 may be performed more properly thus stabilizing outputted images.

Here, it is sufficient that the developer replenishing unit 7 can newly replenish the developer to the inside of the developing housing 2. As a typical mode, a mode in which a transport member is arranged in the inside of the developer replenishing unit 7 and a given amount of developer is replenished by operating the transport member may be named. Further, the developer newly replenished may be a two-component developer or may be constituted of only toner.

Further, it is sufficient that the accumulated information of the outputted image may be information which is calculated in a method which allows a user to understand the accumulation of the used toner. For example, a method which adopts the accumulation of image area ratios of outputted images, a method which adopts the accumulation of changes of toner density, a method which adopts the accumulation of densities of outputted images and the like are named.

Further, the present invention is not limited to the developing device and is applicable to an image forming apparatus which uses such a developing device. In this case, the image forming apparatus is constituted of an image carrier 1 which carries an electrostatic latent image thereon and a developing device, wherein the above-mentioned developing device may be used as such a developing device.

According to an aspect of the present invention, in the developing method which uses the developer consisting of toner and carrier and uses the developing bias which superposes the AC component to the DC component, the AC component of the developing bias is set to the reference value when the volume resistivity of the developer detected by the volume resistivity detecting unit falls within the given range and, while the AC component of the developing bias is corrected such that the image evaluation parameters fall within the allowable range when the volume resistivity of the developer exceeds the given range and hence, it may be possible to provide the developing device which can maintain the favorable image quality over a long period.

Further, with the use of such a developing device, it may be possible to provide an image forming apparatus which exhibits stable image quality.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-240432 filed on Aug. 22, 2005 including specification, claims, drawings and abstract is incorporated herein by reference in its entirety.

What is claimed is:

1. A developing device comprising:

a developing housing that faces an image carrier on which an electrostatic latent image is carried and stores a developer which contains toner and magnetic carrier is housed in;

a developer carrier that is disposed apart from the image carrier in the developing housing and carries and transports the developer;

a developing bias applying unit that is disposed between the image carrier and the developer carrier and applies a developing bias for developing the electrostatic latent image on the image carrier, the developing bias comprising an AC component and a DC component, the AC component being superposed to the DC component;

a volume resistivity detecting unit that detects a volume resistivity of the developer on the developer carrier; and a developing bias adjusting unit that sets the AC component of the developing bias to a reference value when the volume resistivity of the developer detected by the volume resistivity detecting unit falls within a given range, and corrects the AC component of the developing bias to cause an image quality evaluation parameter to fall within an allowable range when the volume resistivity of the developer exceeds the given range.

2. The developing device according to claim 1, wherein the volume resistivity detecting unit includes a retractable electrode member which contacts with the developer on the developer carrier and the volume resistivity of the developer is detected between the electrode member and the developer carrier.

3. The developing device according to claim 1, wherein the developing bias adjusting unit corrects the AC component of the developing bias based on a correction condition which is obtained beforehand.

4. The developing device according to claim 1, further comprising an image density detecting unit that detects an image density of an image visualized by toner in the developer, and a controller that adjusts a developing condition except for the AC component of the developing bias based on information from the image density detecting unit.

5. The developing device according to claim 1, further comprising a developer replenishing unit that replenishes a new developer to the inside of the developing housing, wherein an operation period of the developer replenishing unit is set based on accumulated information of outputted images.

6. The developing device according to claim 1, wherein a developing bias adjusting unit corrects at least either one of an amplitude or a frequency of the developing bias AC component.

7. An image forming apparatus comprising:

an image carrier that carries an electrostatic latent image; and a developing device comprising:

a developing housing that faces the image carrier on which an electrostatic latent image is carried and stores a developer which contains toner and magnetic carrier is housed in;

a developer carrier that is disposed apart from the image carrier in the developing housing and carries and transports the developer;

a developing bias applying unit that is disposed between the image carrier and the developer carrier and applies a developing bias for developing the electrostatic latent image on the image carrier, the developing bias comprising an AC component and a DC component, the AC component being superposed to the DC component;

a volume resistivity detecting unit that detects a volume resistivity of the developer on the developer carrier; and a developing bias adjusting unit that sets the AC component of the developing bias to a reference value when the volume resistivity of the developer detected by the volume resistivity detecting unit falls within a given range, and corrects the AC component of the developing bias to cause an image quality evaluation parameter to fall within an allowable range when the volume resistivity of the developer exceeds the given range.

* * * * *